US005446446A

United States Patent [19]

Harman

[11] Patent Number: 5,446,446

[45] Date of Patent: Aug. 29, 1995

[54] DIFFERENTIAL, MULTIPLE CELL REFLEX CABLE INTRUSION DETECTION SYSTEM AND METHOD

[75] Inventor: R. Keith Harman, Tempe, Ariz.

[73] Assignee: Southwest Microwave, Inc., Tempe, Ariz.

[21] Appl. No.: 296,666

[22] Filed: Aug. 26, 1994

Related U.S. Application Data

[63] Continuation-in-part of Ser. No. 164,364, Dec. 9, 1993.

[51] Int. Cl.[6] ..... G08B 13/00

[52] U.S. Cl. ..... 340/566

[58] Field of Search ..... 340/561, 566, 552, 550, 340/564, 554, 541

[56] References Cited

U.S. PATENT DOCUMENTS

| | | | |
|---|---|---|---|
| 3,384,887 | 5/1968 | Trimble | 340/552 |
| 3,750,125 | 7/1973 | Ross et al. | 340/561 |
| 3,763,482 | 10/1973 | Burney et al. | 340/552 |
| 3,801,976 | 4/1974 | Ross et al. | 340/552 |
| 4,023,155 | 5/1977 | Miller | 340/552 |
| 4,091,367 | 5/1978 | Harman | 340/552 |
| 4,197,529 | 4/1980 | Ramstedt et al. | 340/566 |
| 4,482,890 | 11/1984 | Forbes et al. | 340/556 |
| 4,562,428 | 12/1985 | Harman et al. | 340/552 |
| 4,571,578 | 2/1986 | Karas | 340/564 |
| 4,760,295 | 7/1988 | Macalindin | 340/550 |
| 4,906,975 | 3/1990 | Casella et al. | 340/566 |
| 4,994,789 | 2/1991 | Harman | 340/552 |
| 5,068,642 | 11/1991 | Hruby et al. | 340/562 |
| 5,194,847 | 3/1993 | Taylor et al. | 340/557 |

FOREIGN PATENT DOCUMENTS

| | | | |
|---|---|---|---|
| 1160300 | 1/1984 | Canada | 337/67 |

OTHER PUBLICATIONS

"Guardwire 400 Series, New Technology for Fence Protection", Copyright Southwest Microwave, Inc. 1291-400.

"FPX-2-2-M Fence Protection System", Perimeter Products.

"Sentrax Network System for Outdoor Perimeter Intrusion Detection", Senstar Corporation.

"Focas, Perimeter Protection Products for Security and Surveillance", Focas Limited.

"Fiber Optic Intrusion Detection Systems", Fiber SenSys, A Corning Affiliate.

"E-Flex II TM Outdoor & Indoor Security System", Stellar Systems, Product Data.

"Wire-in -Tube Sensor" by Fred G. Geil and Heinz Gilcher, Proceedings 1974 Carnahan and International Crime Countermeasures Conference, Apr. 16-19, 1974, pp. 4-8.

*Primary Examiner*—John K. Peng

*Assistant Examiner*—Benjamin C. Lee

*Attorney, Agent, or Firm*—Cahill, Sutton & Thomas

[57] ABSTRACT

A transducer cable includes an inner conductor, an outer conductor, and dielectric between the inner conductor and the outer conductor. A longitudinal passage and a sense wire loosely disposed therein extend through the dielectric. Movement, (e.g., intruder-caused vibration) of the transducer cable results in movement of the sense wire relative to the outer conductor, causing corresponding changes in characteristic impedance of the sense wire. A carrier signal transmitted down the inner conductor produces an electromagnetic field that couples energy to the sense wire. The change in characteristic impedance causes reflection of some of the coupled energy, which produces a corresponding signal that is sensed by a receiver circuitry. The receiver circuitry produces a signal indicating the occurrence of the intruder caused vibration. The receiver circuitry includes a system that digitizes the received signals at successive times that correspond to successive sections of the cable, performs digital filtering to eliminate a cable profile or clutter response, and produces target response values for sections of the cable that undergo changes in characteristic impedance. Target responses in several adjoining sections are interpolated to precisely locate the intrusion activity causing the vibrations.

7 Claims, 8 Drawing Sheets

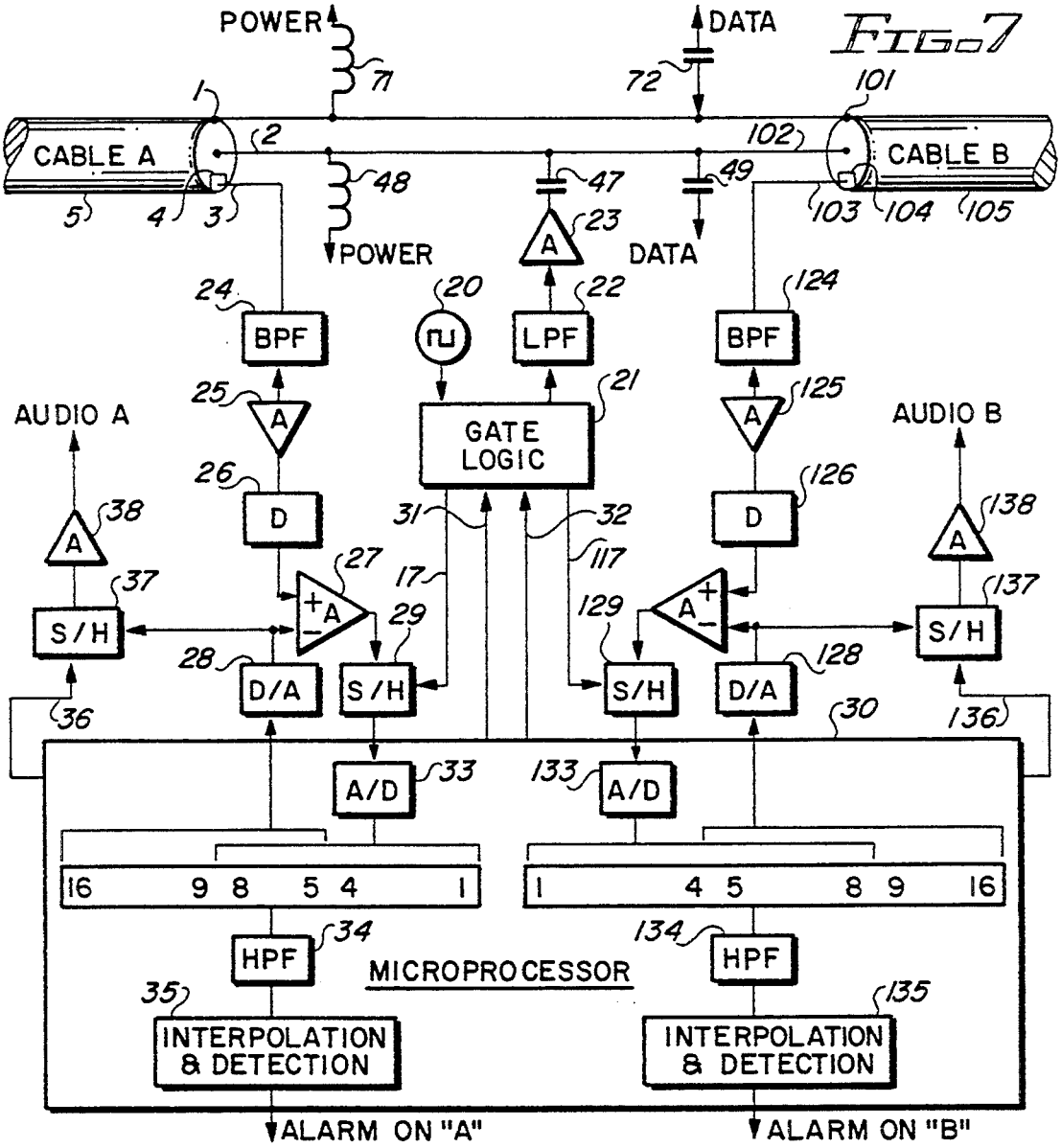
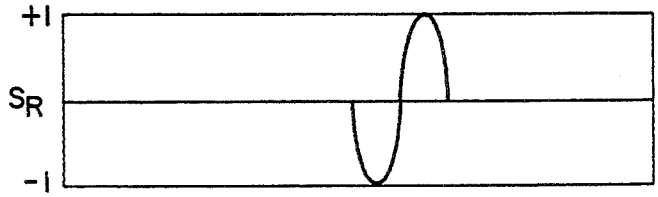
FIG. 11B
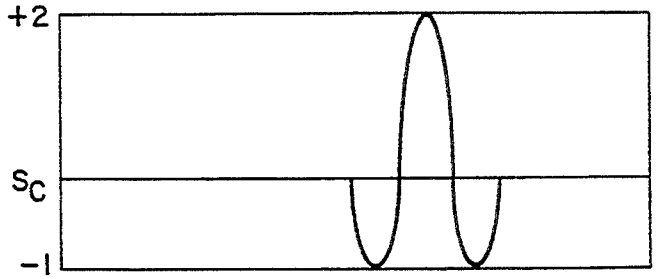
FIG. 11C

DIFFERENTIAL, MULTIPLE CELL REFLEX CABLE INTRUSION DETECTION SYSTEM AND METHOD

CROSS REFERENCE TO RELATED APPLICATION

This is a continuation-in-part of commonly assigned application Ser. No. 08/164,364, filed Dec. 9, 1993.

BACKGROUND OF THE INVENTION

The invention relates to coupled transmission line sensors or acoustic cable sensors, and more particularly to a coaxial cable with one or more sense conductors moveable relative to another conductor in response to intruder-caused movement or vibration and a system operative to process a signal coupled to the sense conductor to detect and locate characteristic impedance changes of the sense conductor due to the intruder-caused movement or vibration.

There are numerous acoustic cable outdoor perimeter security sensors on the market today. These are based on six main sensor technologies, including 1) electret effect, 2) inductive coupling, 3) capacitive coupling, 4) triboelectric effect, 5) piezoelectric effect, and 6) fiber optic transmission.

All of the foregoing technologies have been used to create line sensors, referred to as "sensor cables", "transducer cables", or "acoustic cables", which act as distributed microphones. Typical transducer cable "zone lengths" are from 10 to 300 meters. In many cases transducer cables have been attached to chain link fences to detect intruders climbing the fences or cutting through them. While some of the prior transducer cables are relatively low cost devices, they result in an excessive number of false alarms due to (1) rain or hail striking the cable, (2) wind blown objects hitting the fence, or (3) the wind induced motion of the fence itself.

In other cases, the known transducer cables are buried in the ground to detect seismic activity caused by intruders moving over the cable. The inability of detection systems using such transducer cables to accurately distinguish between intruders walking over the cable and vehicular traffic moving at a distance from the cable is a major cause of false alarms. When the number of false alarms is too high, the monitoring service or response force often merely turns the equipment off.

In every case, the transducer cable installer sets a single threshold which must be exceeded to cause an alarm. The setting of this threshold always is a compromise. If it is set too low, the number of false alarms is too large. If it is set too high, the probability of detecting an intruder is too low. The longer the length of the transducer cable, the more difficult the compromise becomes. This is because the longer the transducer cable, the more background noise it picks up, thereby decreasing the signal-to-noise ratio. Also, the longer the transducer cable, the larger is the variation in sensitivity of the cable to physical vibrations along its length of the cable. For fence applications, this variation in sensitivity can be due to variations in cable construction, variations in fence conditions, variations in installation, and attenuation in the sensor cable itself. For buried applications, sensitivity to physical vibrations is affected by imperfections in cable construction and changes in the properties of the ground or burial medium.

The above mentioned prior art electret sensor cables were introduced in the 1970's, and presently are probably the most commonly used acoustic sensor cable. An electret cable sensor includes a coaxial cable with an electret dielectric, such as Teflon. A permanent charge is imposed upon the Teflon during the cable fabrication. In some cases, manufacturers simply rely on the charge imposed on the cable during the manufacturing process, while in other cases the charge is deliberately imposed on the cable after it is manufactured by heating the cable to near its melting point and applying a voltage to the cable. This charge will remain in the cable dielectric for many years. When the cable is subjected to physical vibration, the relative motion of the cable conductors and the charge on the electret dielectric causes a corresponding voltage to be generated at the end of the cable. It is this voltage which is sensed to detect the presence of an intruder. The cost of the electret dielectric material is a significant factor in the overall cost of this type of sensor cable, as teflon is several times more expensive than polyethylene, which is the most common dielectric used in the manufacture of coaxial cables. An example of a commercially available electret sensor cable is the FPS-2 device made by Perimeter Products Inc. of Mountain View Calif. U.S. Pat. Nos. 3,384,887 issued May 21, 1968, 3,763,482 issued Oct. 2, 1973 and 4,023,155 issued May 10, 1977 describe this technology.

The known capacitive coupling transducer cables are used by applying a voltage across the conductors of a coaxial cable using a very high impedance source and then detecting minute changes in current therein needed to maintain this voltage while flexing of the cable causes changes in its capacitance. Problems relating to the high impedance sources required for such sensor cables have limited their application. An example of a commercially available capacitive coupling sensor cable is a buried sensor cable made by H.E.S.A. of Milan, Italy, based upon U.S. Pat. No. 5,068,642 which issued Nov. 26, 1991.

Known inductive coupling transducer cables utilize permanent magnetic material with embedded conductors. The conductors are allowed to move within a slot in the magnetic material in response to acoustic stimulus, thereby generating a voltage at the end of the sense cable. The cost of the magnetic material and the difficulty in manufacturing cable using the magnetic material are the most significant factors in determining the cost of inductive coupling transducer cables. An example of a commercially available inductive coupling transducer cable is the GUARDWIRE device produced by Geoquip Corp. of Wirksworth, United Kingdom and sold in the United States by Southwest Microwave Inc. of Tempe, Ariz.

Known triboelectric transducer cables are constructed using special plastic materials that generate a voltage when one moves against the other. Coaxial cables made with these materials, when flexed, generate a voltage at their terminations. While the materials in a triboelectric sensor cable are less expensive than those in either an electret or an inductive coupling type transducer cable, their performance is not as easily controlled. The transducer function of triboelectric cables can vary from cable to cable for no apparent reason, and their response voltages are not proportional to the amount of cable motion. Nevertheless, there are many triboelectric sensor cables in use today. A commercially available triboelectric sensor cable is the E-FLEX device produced by Stellar Systems Inc. of Santa Clara Calif. U.S. Pat. No. 2,787,784 issued Apr. 2, 1957 and Canadian patent 1,160,300 issued Jan. 10, 1984 describe triboelectric transducer cables.

Known piezoelectric transducer cables use special plastic materials between two conductors in a coaxial cable construction. When flexed, such plastic materials generate a voltage which can be sensed at the termination of the cable. The cost of the special plastic material is the major cost in the construction of the piezoelectric transducer cables. An example of a commercially available piezoelectric cable is the FOCUS device manufactured for Focus Ltd. by Chalice Electronics Ltd. of United Kingdom.

Fiber optic transducer cables were introduced in the 1990's. Flexure of the fiber optic sensor cable alters the transmission of light along an optical fiber, and the effect of such alteration is detected at the end of the line. Fiber optic transducer cables tend to be relatively expensive due to the inherent cost of manufacturing the fiber optics therein. An example of a commercially available fiber optic cable sensor is FIBER SENSYS sold by Fiber SenSys, a Corning Affiliate in Beaverton, Oreg.

It should be noted that sometimes it is difficult to determine exactly how a transducer cable operates because triboelectric effects, electret effects and capacitive coupling all are sensed as a voltage at the end of the sensor cable, and hence all "look" somewhat alike electrically. To many users and some manufacturers, it does not matter how the sensor works as long as it reliably detects intruders. Many users treat the foregoing sensor cables as interchangeable, and simply purchase the lowest cost one.

For long outdoor protected area perimeters requiring multiple sensor units, the procurement and installation of suitable power and data networks are major factors in the total system cost. Due to the nature of perimeter security systems, these power and data transmission networks must be reliable and difficult to sever or spoof, i.e., deceive. The present invention includes a means of including the power and data transmission within the transducer cable. This eliminates the need to procure and install separate power and data lines around the perimeter of the protected area to service the multiple sensor "units". Since the transducer cable is tamperproof, the power and data service elements inside the cable are protected. In a closed perimeter system (one which encloses an entire protected area) the power and data can be supplied in both directions around the protected area perimeter to provide redundance.

My U.S. Pat. No. 4,562,428 describes the application of power and data over a two cable CW (continuous wave) leaky coaxial sensor cable. While the transmission of power and data over the transducer cable subsequently described herein has certain similarities to the system described in my U.S. Pat. No. 4,562,428, the present invention does not utilize leaky coaxial cables. In the present invention, electromagnetic waves are used to detect and locate disturbances inside the cable while U.S. Pat. No. 4,562,428 describes detecting disturbances in the outside air, between the two cables. In the present invention a radio frequency (RF) pulse is transmitted down the sensor cable, and the resulting received signals are processed to detect and precisely locate intruder-caused disturbances. In contrast, the system described in my U.S. Pat. No. 4,562,428 uses continuous wave (CW) transmissions with no capability of locating the intruder-caused disturbance along the lengths of the sensor cables.

My U.S. Pat. No. 4,091,367 describes a pulsed leaky coaxial cable sensor. While the RF pulsed disturbance locator system subsequently described herein also uses RF pulses to locate changes in characteristic impedance on coupled transmission lines, the present invention does not use leaky coaxial cables. Electromagnetic waves are used to detect and locate disturbance inside the sensor cable as opposed to disturbances in the air outside the cables.

A transmission line "presence sensor" is described in U.S. Pat. Nos. 3,750,125 and 3,801,976 by Ross et al. These patents describe a coupled strip line sensor in which the object being detected directly perturbs the electromagnetic coupling. This is similar to my leaky coaxial cable sensor described in U.S. Pat. No. 4,091,367 except that the lines are in close proximity to each other and are much shorter in length than in leaky coaxial cable sensors. In leaky coaxial cable sensors and the Ross et al device, the fields are not contained inside a cable, and the cable need not be physically disturbed by the target for the target to be detected.

U.S. Pat. No. 4,482,890 by Forbes et al describes a coupled fiber optic sensor for the detection and location of disturbances of a cable encompassing a multiplicity of fibers. U.S. Pat. No. 5,194,847 by Taylor et al describes a single fiber optic line with a directional coupler.

There clearly is an unmet need for a lower cost perimeter intrusion detection system capable of reliably detecting presence of an intruder, with much lower likelihood of false alarms from wind, hail, blowing debris and the like than previously has been achievable.

SUMMARY OF THE INVENTION

Accordingly, it is an object of the invention to provide a perimeter intrusion detection system capable of reliably detecting an intruder with much lower likelihood of false alarms caused by wind, hail, blowing debris and the like than previously has been achievable.

It is another object of the invention to reduce the total cost per linear foot of a perimeter intrusion detection system.

It is another object of the invention to provide a system and method for setting zone boundaries other than those imposed by the locations of starting and ending points of a transducer cable.

It is another object of the invention to provide a perimeter intrusion detection system having a higher signal-to-noise ratio than previous systems.

It is another object of the invention to provide a perimeter intrusion detection and method which reduces clutter and rejects interfering signals more effectively than previous systems.

It is another object of the invention to provide a perimeter intrusion detection system including multiple signal detection mechanisms which operate to give multiple indications of an intrusion activity.

Briefly described, and in accordance with one embodiment thereof, the invention provides a transducer cable including an inner conductor, an outer conductor, solid dielectric between the inner conductor and the outer conductor, the outer conductor being tubular, the dielectric being within the outer conductor, a longitudinal passage extending through the dielectric material, and a sense wire extending through the passage and loosely fitting therein so that vibration or flexing of the transducer cable results in movement of the sense wire relative to the outer conductor, providing corresponding changes in the characteristic impedance of a first transmission line formed by the outer conductor and the sense wire. In the described embodiment, the transducer cable is cylindrical, and the passage is a longitudinal slot in the outer surface of the dielectric. A layer of dielectric tape covers the slot. The sense wire is flexible multi-strand wire. A first termination is matched to the characteristic impedance of the first transmission line, and a second termination matched to a characteristic impedance of a second transmission line formed by the inner conductor and the outer conductor. A carrier signal is transmitted down the second transmission line, providing an electromagnetic field which couples energy to the first transmission line. An intrusion activity that causes movement of the transducer cable results in movement of the sense wire relative to the passage, changing the characteristic impedance of the first transmission line and thereby causing a reflection of some of the coupled energy back toward the transmitting circuit and producing a corresponding first signal representative of the reflected energy. A receiver circuit is connected to receive the first signal and amplify the first signal and remove high frequency components from it to thereby produce a second signal. An analog-to-digital converter receives the second signal, and a control circuit applies a conversion signal to the analog-to-digital converter. The conversion signal includes a plurality of convert pulses timed to cause the digital-to-analog converter to digitize values of the second signal representing responses of a plurality of range bin portions of the transducer cable to the second signal. A processor receives the digitized values, performs a high pass digital filtering operation on the digitized values to isolate a disturbance component thereof from a clutter response component, and performs an interpolating operation on the isolated disturbance component to determine a peak value and corresponding location along the transducer cable. Then the processor compares the peak value to a corresponding stored threshold value and generate an alarm signal if the peak value exceeds the threshold value. The intrusion detection system is calibrated by applying a predetermined mechanical threshold disturbance to the transducer cable at each interpolation point, and operating the system as described above to obtain a threshold stimulus response for each subcell, and storing a corresponding threshold for each interpolation point.

In one embodiment, a second longitudinal passage extends through the dielectric material, and a second sense wire extends through the second passage. The second passage is located on the opposite side of the center conductor from the first passage, so that displacement of the transducer cable results in generally opposite relative movement of the first and second sense wires relative to the outer conductor, increasing coupling from the center conductor to the first sense wire and decreasing coupling from the center conductor to the second sense wire. Signals reflected from the location of characteristic impedance change along the first and second sense wires are differentially sensed by applying them across a primary center tapped winding of a pulse transformer. Common mode noise rejection is thereby achieved, reducing resolution requirements of digital signal processing of the output of the pulse transformer.

BRIEF DESCRIPTION OF THE DRAWINGS

FIG. 7 is a diagram illustrating time-sharing of some of the signal processing hardware between two transducer cables.

FIGS. 11A–11C are diagrams useful in explaining how conventional radar techniques can be applied to the present invention.

DETAILED DESCRIPTION OF THE PREFERRED EMBODIMENTS

Figure 1:
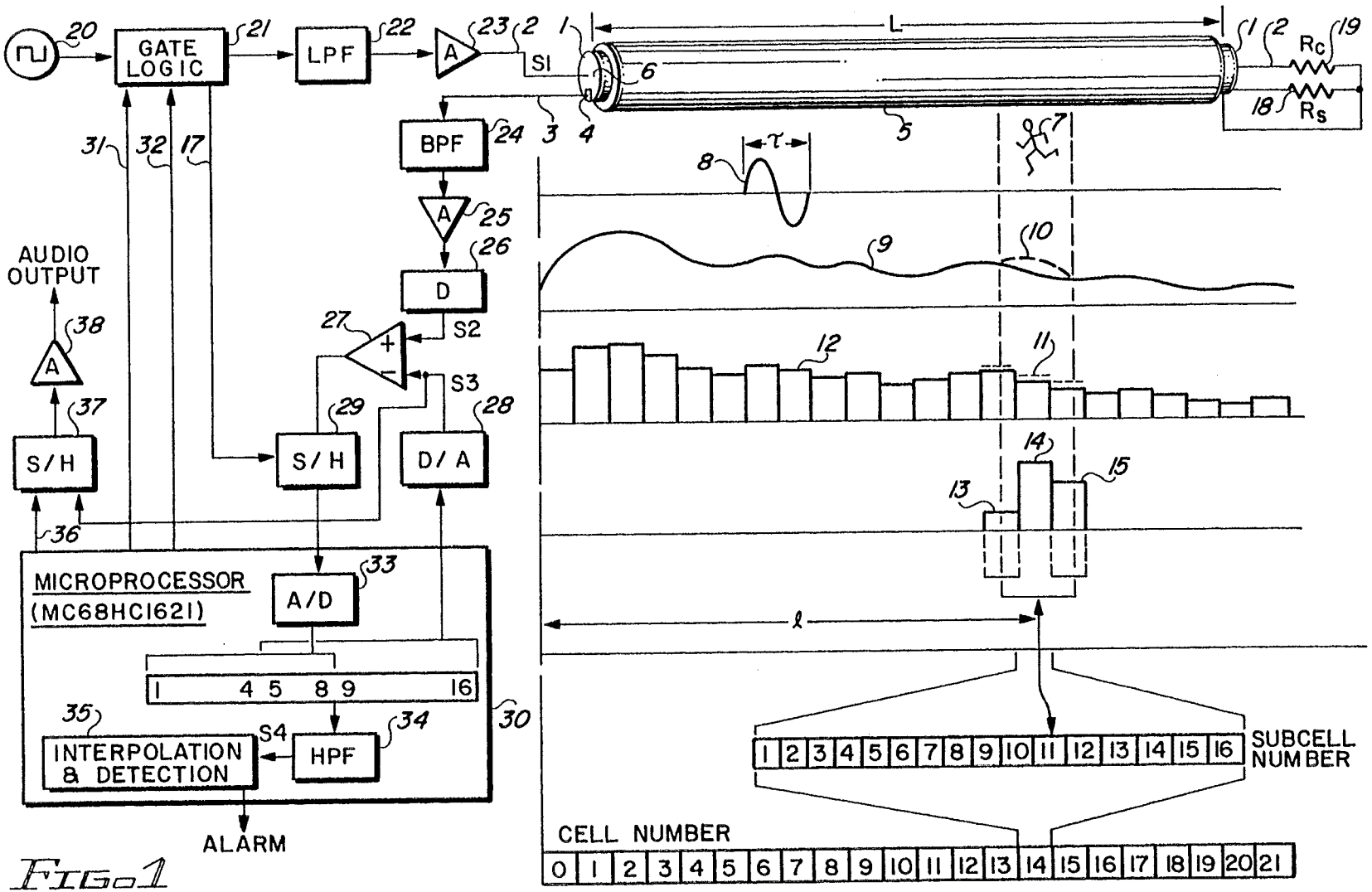
FIG. 1 is a diagram illustrating both the transducer cable intrusion detection systems of the present invention and a related diagram indicating signals occurring at various conductors of the system at times corresponding to various signal propagation distances along the transducer cable.
Figure 2:
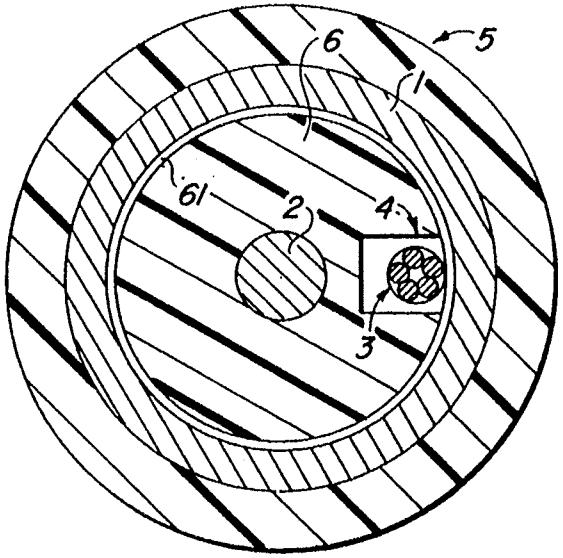
FIG. 2 is a cross sectional view of the transducer cable used in the systems of FIG. 1.

Referring to FIGS. 1 and 2, a transducer cable 5 of length L meters comprises an outer conductor 1, a center conductor 2 and a sense wire 3. The cable length L typically is between 20 and 200 meters, although it could be as little as 3 meters. Sense wire 3 is free to move relative to the outer conductor of the cable 5 within a slot 4 formed in the dielectric material 6. An intruder 7 causes a physical disturbance of cable 5 at distance $\lambda$ meters from the beginning thereof. The physical motion (i.e., vibrations) of cable 5 at location $\lambda$ causes the "floating" sense wire 3 to move relative to outer conductor 1 within slot 4. The physical motion of sense wire 3 is detected and its position is precisely located in order to detect and precisely locate intruder 7.

Center conductor 2 and outer conductor 1 of transducer cable 5 form an ordinary coaxial cable transmission line 1,2. This transmission line is terminated in a resistor 19 of Rc ohms, Rc being the characteristic impedance of the transmission line 1,2.

Sense wire 3 and outer conductor 1 also form a transmission line 1,3. The separation of sense wire 3 from outer conductor 1 varies as sense wire 3 moves within slot 4 relative to outer conductor 1 (due to vibration of cable 5), thereby altering the characteristic impedance of the "sense wire transmission line" 1,3. Sense wire 3 is terminated in resistor 18 of Rs ohms, Rs being equal to the average characteristic impedance of sense wire transmission line 1,3.

Sense wire transmission line 1,3 and coaxial transmission line 1,2 share the same outer conductor 1, so their associated electromagnetic fields occupy much of the same space. Consequently, there is electromagnetic coupling between these two transmission lines. A signal imposed upon coaxial cable transmission line 1,2 creates a signal on sense wire 3. The degree of coupling depends mainly upon the relative spacing between conductors 1, 2 and 3. Hence, physical disturbances of transducer cable 5 cause changes in the magnitude of the signal coupled from transmission line 1,2 to transmission line 1,3 at the location of the disturbance. It is this change in the signal coupled from transmission line 1,2 to transmission line 1,3 which is detected and located, to thereby detect and locate intruder 7.

Although transducer cable 5 can be any three-conductor line in which appropriate electromagnetic coupling occurs between conductors, it is convenient to use a coaxial construction as illustrated in FIG. 2. Conductor 2 is at the center of the cable, surrounded by a cylindrical dielectric sleeve 6. Cylindrical conductor 1 is placed about dielectric sleeve 6 to form an outer shield. Slot 4 formed in the dielectric sleeve 6 loosely encloses sense wire 3. Sense wire 3 therefore "floats" in slot 4, randomly touching all four sides of the slot at various points along the length of transducer cable 5. Outer conductor 1 has a very thin insulating layer 61 on its inner surface to prevent shorting between conductors 1 and 3. Outer conductor 1 is surrounded by a stout jacket 12 to provide mechanical protection to the cable. The jacket 12 can be high density polyethylene, which produces a fairly rigid, non-flaccid cable structure. Insulating layer 61 can be composed of aluminum-polyester tape.

When cable transducer 5 is physically disturbed, sense wire 3 moves relative to the boundaries of slot 4, altering the characteristic impedance of sense wire transmission line 1,3, and therefore also alters the coupling between it and the coaxial transmission line 1,2.

In a prototype embodiment of the invention, a standard RG58U type cable was adapted to form transducer cable 5. Center conductor 2 is a 20 AWG conductor having a diameter of 0.032 inches. The dielectric material or core 6 is solid polyethylene. Slot 4 has a width of 0.028 inches and a depth of 0.030 inches. Sense wire 3 is a 26 AWG stranded wire formed from seven 34 AWG conductors having an overall diameter of 0.019 inches. Polyethylene core 6 is surrounded by a 7/16 inch wide aluminum-polyester tape 61 with the polyester layer on the inside to prevent conductor 3 from shorting to aluminum foil on the outside. Aluminum polyester tape 61 can be foil tape produced by Facile Technologies of Paterson N.J., having a 0.00092 inch thick polyester film and a 0.00035 inch layer of aluminum. Tape 61 is applied in a "cigarette wrap", with its "overlay" occurring on the opposite side of dielectric core 6 from slot 4. Tinned copper 78 percent braided shield is applied over foil 61, the copper braid making electrical contact with the aluminum side of foil 61. A black solid polyethylene jacket is applied over the braid resulting in a cable with an overall diameter of 0.193 inches. (The use of black jacket material prevents damage due to ultraviolet radiation.)

The above dimensions of slot 4 and the diameter of sense wire 3 for the prototype embodiment were determined experimentally. Slot 4 must be sufficiently large to allow sense wire 3 to move or "float" freely therein. The mass and flexibility of sense wire 3 affect its ability to respond to physical disturbances (i.e., intruder-caused vibrations) of transducer cable 5. The electrical conductivity and diameter of sense wire 3 determines the attenuation of sense wire transmission line 1,3. While sensor performance may be further optimized by adjusting the slot dimensions and through the use of a different sense wire, the foregoing dimensions were found to be effective.

The coaxial transmission line 1,2 has a characteristic impedance of 52 ohms. The sensor wire transmission line 1,3 has an average characteristic impedance of 60 ohms. The coupling loss between these two transmission lines has been found to be approximately 16 decibels. Coaxial transmission line 1,2 has a relative velocity of 66%, and the sense wire transmission line 1,3 has a relative velocity of 97%. This results in an average relative velocity of 81.5%. The attenuation at 5.8 MHz for coaxial transmission line 1,2 is 6 dB per 100 meters and for sense wire transmission line 1,3 is 10 dB per 100 meters. The above described transducer design has proven to be effective for an intrusion detection system.

The crystal oscillator 20 produces a clock signal which is used to create the RF pulse 8 as well as a sample pulse on conductor 17 upon command from microprocessor 30. A frequency of 5.887 MHz clock has a cycle time of 169.85 nanoseconds, although signals from 1 to 100 MHz might be used. Microprocessor 30 sends a start command to the logic circuit 21 on line 31 along with a "cell number" N to be sampled on line 32. Logic circuit 21 responds by turning on a switch for a number of cycles and by initiating a zero crossing counter (not shown). A single cycle RF pulse designated by numeral 8 in FIG. 1 is used in the present invention. RF pulse 8 is a 169.85 nanoseconds in duration. When the zero crossing counter reaches the cell number N requested by microprocessor 30, a switch is turned on until the next zero crossing to generate a 84.925 nanosecond sample pulse. This sample pulse is sent on line 17 to the Sample and Hold (S/H) circuit 29 in order to digitize the response signal for the selected cell. The time delay between the onset of the RF pulse 8 and the start of the sample pulse is N times the 84.925 nanosecond zero crossing period.

A single cycle RF square wave pulse produced by the gate logic 21 is passed through low pass filter 22 to remove the harmonics of the 6.47 MHz pulse, so as to generate a sinusoidal pulse which is amplified in RF amplifier 23 to produce the single cycle sinusoidal RF pulse 8 which is applied to the coaxial transmission line 1,2. Signal trace S1 in FIG. 1 depicts RF pulse 8 at an instant of time as it propagates along the coaxial transmission line.

RF pulse 8 propagates at a velocity of $v_2$ meters per second where $v_2$ is less than the free space velocity c of $2.998\times10^8$ meters per second. The ratio of $v_2/c$ is the relative velocity of the coaxial transmission line 1,2 which is essentially the inverse of the square root of the relative permittivity of the dielectric material 6 separating conductors 1 and 2. For a solid polyethylene dielectric the ratio of $v_2/c$ is 0.66. In other words the RF pulse 8 propagates along the transmission line 1,2 at 0.197868 meters per nanosecond, which is 66% the velocity of light. When RF pulse 8 reaches the end of the cable it is terminated in a matched load 19. For the cable shown in FIG. 2 the characteristic impedance, Rc, is approximately 52 ohms.

As RF pulse 8 propagates along coaxial transmission line 1,2 energy is coupled into sense wire transmission line 1,3. Signals propagate on sense wire transmission line 1,3 at a relative velocity $v_3$ where $v_3$ is less than c and more than $v_2$. Velocity $v_3$ is higher than $v_2$ due to the air surrounding sense wire 3 in slot 4. In the cable shown in FIG. 2, $v_3$ was found to be 0.290806 meters per nanosecond, which is 97% of the velocity of light. The forward coupled signal is terminated in matched load 18, which for the cable shown in FIG. 2 has a characteristic impedance, Rs, of approximately 60 ohms.

The coupled signal of particular interest to the detection and location of intruder 7 is the one which is reflected or propagates backwards on sense wire transmission line 1,3 as the RF pulse 8 propagates forward along coaxial transmission line 1,2. The time that elapses before the signal reflected at location $\lambda$ returns to the start of cable 5 is $\lambda/v_2$, (the time taken for RF pulse 8 to propagate on the coaxial cable 1,2 to location $\lambda$) plus $\lambda/v_s$ (the time taken for the reflected pulse to propagate back on the sense wire line 1,3 to the start of cable 5). Note that for signals coupled at two points that are ten meters apart, the time difference in the signals arriving back at the start of cable 5 is $10\times(1/v_2+1/v_3)$. For the values of $v_2$ and $v_3$ associated with the cable shown in FIG. 2 is 84.925 nanoseconds, this time period corresponds to the cell width.

Thus, when intruder 7 physically disturbs cable 5, sense wire 3 moves within slot 4 of cable 5, causing a change in the coupled signal as RF pulse 8 passes the location of the disturbance. If the disturbance is located $\lambda$ meters from the start of cable 5, then the change in coupling will be received at the start of the cable $\lambda/v_2+\lambda/v_3$ seconds from the onset of RF pulse 8.

The signal appearing on sense wire 3 at the start of cable 5 is referred to as the "received signal". It lasts for the length of RF pulse 8 plus $L/v_2$ plus $L/v_3$ seconds. For a 169.85 nanosecond pulse and a 200 meter length of cable the received signal lasts for 1.868 microseconds. This signal is passed through band pass filter 24 to remove noise outside the band occupied by RF pulse 8. The frequency band occupied by a one cycle pulse of a 5.887 MHz signal is from 2.9 to 8.7 MHz.

The selection of the RF operating frequency is a design compromise. The higher the frequency, the more accurately sensor cable 5 and the system of FIG. 1 the sensor can locate an intruder and the better it can resolve between two intruders located in close proximity to each other. On the other hand, the higher the RF operating frequency, the more attenuation there is in cable 5. The length of cable 5 that can be accommodated is inversely proportional to the cable attenuation, given a processor with a finite dynamic range. An operating frequency of 5.8 MHz seems to be a reasonable compromise.

The output of band pass filter 24 is amplified by RF amplifier 25 and passed to detector 26 to obtain the "base band" (some times referred to as video) response illustrated as S2 in FIG. 1. Any of the standard types of detectors used in radar could be used, including synchronous and coherent detectors. In the present example, a diode square law detector is used. In effect, this detector receives the RF input signal on sense conductor 3 and produces a base band output that is proportional to the envelope of that RF input signal.

In order to process the base band signal 52 produced by detector 26, it is convenient to digitize it into 22 "range cells" using a 16 bit microprocessor such as the MC68HC16Z1 from Motorola. Because it takes a relatively long time to digitize the value stored in the S/H (sample and hold) circuit 29, it is desirable to only take one sample per transmitted RF pulse 8. Hence, it requires the transmission of 22 RF pulses 8 to collect the 22 "range cell" numbers which describe the cable profile, i.e, the response of cable 5 to RF pulse 8.

The number of bits required in the process of digitizing the cable profile determines the dynamic range of the digital signal processing. The most significant bit must describe the largest profile at the start of the cable, and the least significant bit must "see" the smallest target change from the end of the cable. Since the target-to-profile ratio combined with the cable attenuation effect is in the order of 60 dB, at least 10 bits and preferably 16 bits of dynamic range are needed to digitize the cable profile. The more bits that are required, the longer the amount of time required for each A/D conversion.

The feedback circuitry illustrated in FIG. 1 provides a practical means of obtaining the dynamic range of a 16 bit number with the conversion speed of an 8 bit A/D for the digitization of the base band response signal 52. Since the base band signal S2 is virtually stationary once the cable is installed, with only very minor changes occurring due to physical disturbances, it is convenient to use 12 bit digital-to-analog (D/A) converter 28 to feed back the most significant 12 bits, $xU_{j(i-1)}$, of the most recent 16 bit quantization of the particular cell of interest. (Note that the subscripts j and i are used to denote cell number and sample number, respectively.) The 8 bit A/D converter 33 then can be used to quantize the least significant bits $xL_{ji}$. Differential amplifier 27 subtracts the output of 12 bit D/A converter 28 from the output of detector 26 to provide the desired 24.08 db of gain required to properly "align" the 12 bit D/A converter 28 and 8 bit A/D converter 33. (A gain of 24.08 dB corresponds to a binary shift of exactly 4 bits.)

The resulting 16 bit number $x_{ji}$ is not "accurate" to 16 bits, but since it has 16 bits of resolution it is well suited to the problem at hand. The resulting array of 22 numbers, $x_{ji}$, j=0,1,2, ... 21,22, represents the stationary cable profile plus the cable target response at instant i. The above described feedback process provides an adequate dynamic range of 97 dB.

The MC68HC16Z1 microprocessor includes an A/D converter 33 which can be used to digitize the difference value produced by differential amplifier 27. Unfortunately, the Sample and Hold (S/H) circuits included in the MC68HC16Z1 microprocessor are not fast enough to capture the 84.925 nanosecond sample required to quantify the base band signal for a 10 meter wide cell, so an external S/H circuit 29 is used to capture the sample from amplifier 27 and hold it while A/D converter 33 inside microprocessor 30 performs the 8-bit A/D conversion, which requires approximately 9 microseconds. If the microprocessor 30 is used to digitize the 44 data cells associated with two 200 meter lengths of sensor cable 5, approximately 400 microseconds are required. This means that a sample repetition rate of approximately 2.5 KHz can be realized, so each "range cell" value is updated every 400 microseconds.

Figure 3C:
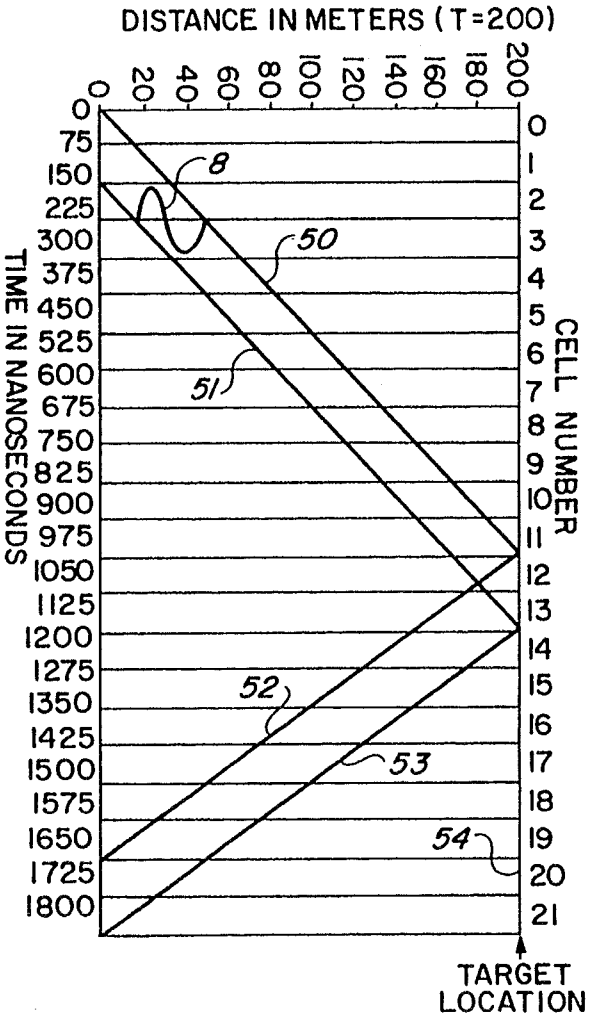
FIGS. 3A–3C are diagrams useful in explaining propagation in the transducer cable of FIG. 1 of a transmitted RF pulse and reflection thereof by a disturbance.
Figure 3B:
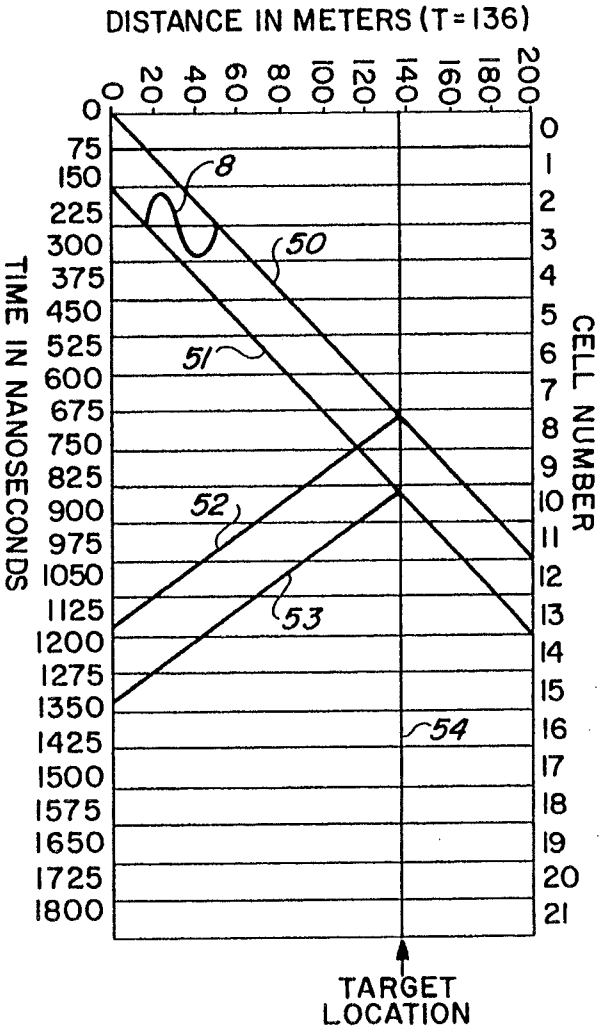
Figure 3A:
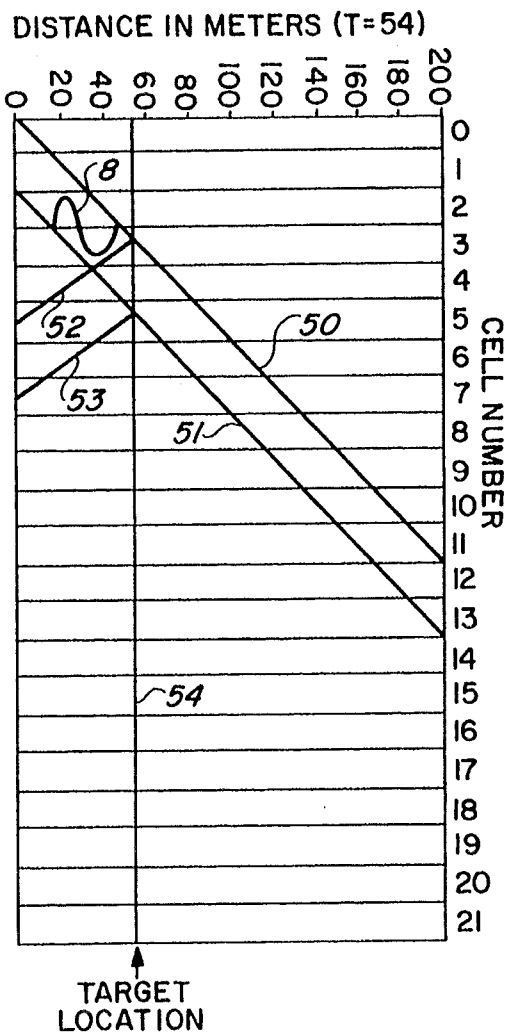

Before proceeding with the description of the digital signal processing, it will be helpful to visualize the complete sampling process as shown in the timing charts of FIGS. 3A–C. These timing charts show how "transmit" pulse 8 propagates down coaxial cable 1,2 and how a reflection from a target propagates back on sense wire line 1,3 to the start of cable 5. FIGS. 3A–C show the effect of a target or disturbance 7 at 54, 136 and 200 meters, respectively, from the start of cable 5. The horizontal axis in each chart is the distance in meters from the start of cable 5, and the vertical axis is the time in nanoseconds from the onset of transmit pulse 8. Lines 50 and 51 represent the leading and trailing edges of target pulse 8 as it propagates down coaxial transmission line 1,2.

The slope of lines 50 and 51 is determined by the 0.197868 meters/nanosecond velocity of propagation in coaxial transmission line 1,2. The leading and trailing edges of the "return pulse" reflected by target 7 are shown as lines 52 and 53 respectively. The slope of lines 52 and 53 represents the 0.290806 meters/nanosecond velocity of propagation in the sense wire line 1,3.

The horizontal lines in FIGS. 3A–C occur every 84.925 nanoseconds, and represent boundaries between range cells that are 10 meters wide. From FIG. 3A, wherein target 7 is located at T=54 meters, the return pulse arrives in range cell 5 and ends in cell 7. From this information it is known that the target is in range cell 6 and the relative size of the responses in range cells 5 and 7 defines precisely where target 7 is located within range cell 6. Similarly, FIG. 3B shows that for target 7 located at T=136 meters, the return pulse arrives in range cell 13 and ends in range cell 15, so target 7 therefore is located in range cell 14. This corresponds to the response shown in FIG. 1. FIG. 3C illustrates the case wherein target 7 is located at the end of cable 5 and the return pulse is completed at 1868 nanoseconds, which is the end of range cell 21. From this diagram it is apparent that 22 range cells (0,1,2, ... 20,21) are required to locate a target within the central 20 range cells, as a target can never appear in range cells 0 or 21 (for a 200 meter length of cable with 10 meter wide cells).

Each of the samples corresponding to the 22 range cells are passed through a recursive single pole high pass filter algorithm or process represented by block 34 in microprocessor 30 to compute the "response profile" 54 illustrated in FIG. 1. Since in FIG. 1, the disturbance 7 occurred in range cell 14, only range cells 13, 14, and 15 contain significant response values, which are labelled 13, 14, and 15. Note that while all other range cells are shown to have zero responses, there in fact would be small response values in these range cells also, corresponding to system noise. However, these response values would be much less than those in the three range cells 13, 14, and 15, and hence can be disregarded.

The next step in the digital processing performed by microprocessor 30 is to compute the peak to null value of each response $x_{ji}$ over a time interval of 256 samples. At a sample rate of 2.5 KHz this represents a time window of 102.4 milliseconds, i.e.

$$y_{jk}=\max[x_{ji}]-\min[x_{ji}],$$

where i=1,2, ... 256 and where k refers to the each 102.4 millisecond period.

In the interpolation of the response values in range cells 13, 14, and 15 to locate the disturbance 7 within cell 14 and to simplify the detection process, it is preferable to use the logarithm of each of the range cell values. While one could use any logarithm, it is convenient to use the logarithm to the base 2 since there is a very quick and reasonably accurate approximation to the logarithm to the base 2 which can be applied. That is, with the number stored in binary form, the number can be repeatedly divided by 2 by repeated binary shifting until only the most significant bit remains. The number of shifts is the characteristic of the logarithm and the number that was shifted out (the lesser significant bits) are treated as the mantissa. This approximate logarithm function will be referred to as L2(y) where y is the argument of the function.

Such use of logarithmic values conveniently compensates for cable attenuation. Clearly, as the signals propagate in coaxial transmission line 1,2 and in sense wire transmission line 1,3 they are attenuated. This attenuation is largely due to resistive losses in the three conductors 1,2 and 3. For coaxial transmission line 1,2 the attenuation is in the order of 6 dB/100 meters of cable length, and for the sense wire line it is approximately 10 dB/100 meters. For each 10 meter length of cable 5, the target response is attenuated by 1.6 dB. In order to compensate for this loss, the target response value in each range cell can be increased by 1.2×N, where N is the cell number. Using the L2 function, 0.263 ×N is simply added to the L2 value stored for each range cell [0.263=L2(1.2)]. These attenuation factors are computed and stored in a look up table, which is much faster than performing 22 multiplications.

The response magnitudes for range cells 1,2, .... 20 are computed using the following equation $$R_{jk}=L2(y_{jk})+0.263j,$$

where j=1,2,...,20.

The response magnitude, $R_{jk}$, accurately represents the L2 magnitude of the peak-to-peak signal over the kth time interval in cell j (regardless of the subcell). However, there are individual thresholds for each of the 320 subcells along each 200 meter length of sensor cable. Once processor 30 determines the precise subcell location of target 7, the response magnitude $R_{jk}$ can be compared to the threshold $T_{j,\delta}$, $\delta$ being the number of the subcell having the peak response to target 7.

The first step in the algorithm for interpolation of the precise location of the maximum target response is to search the response profile to find the most prominent feature. One means of accomplishing this is to compute a new array $z_{jk}$, j =1,2, .... 20 where $$z_{jk}=L2\{y_{jk}-[y_{(j+1)k}+y_{(j-1)k}]\}+0.263\,j,\ j=1,2,\ldots 20$$

and searching for the peak value of $z_{ji}$ over j=1, 2, ... 20. The value of j at which the peak is found is the range cell containing the target. In the example illustrated in FIG. 1 and FIG. 3B the most prominent range cell is number 14 (i.e. j=14).

Figure 4:
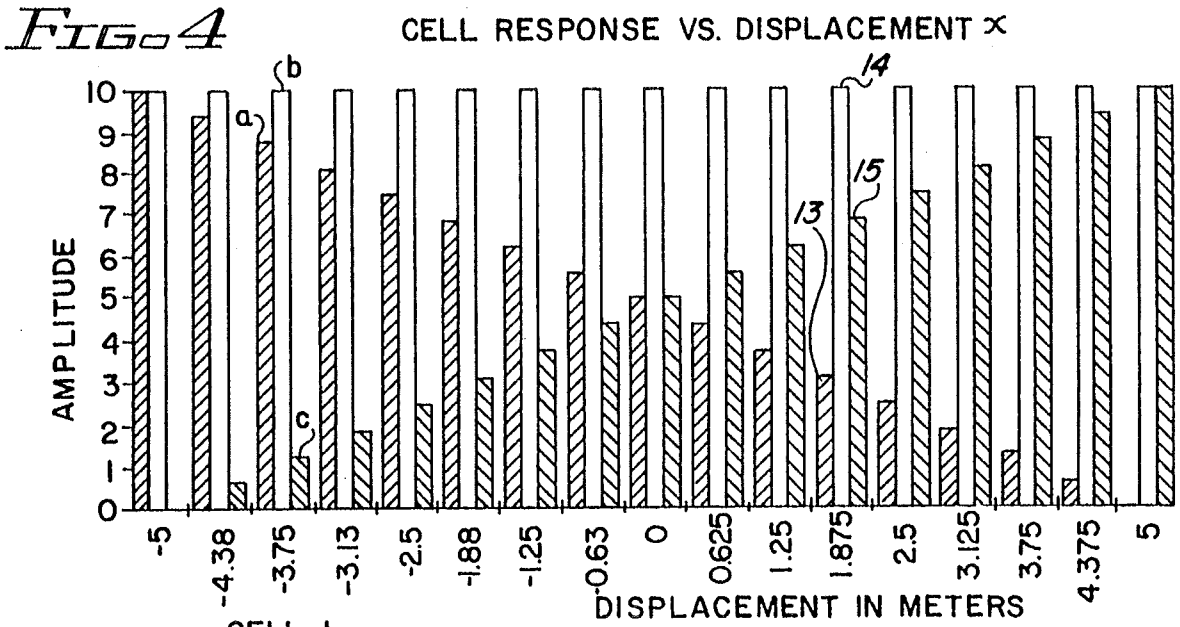
FIG. 4 is a diagram useful in describing interpolation of a disturbance location within a range cell on the basis of target response levels in the range cell and two adjoining range cells.

Referring to FIG. 4, since the peak response occurs in range cell 14, there is also a response labeled 13 in range cell 13 and a response labeled 15 in cell 15 because RF pulse 8 is two range cells wide. Since the target location is closer to range cell 15 than range cell 13, response 15 in cell 15 is larger than response 13 in range cell 13. The ratio of response 13 in range cell 13 to response 15 in range cell 15 is used to interpolate the subcell location of the actual response peak.

Figure 5:
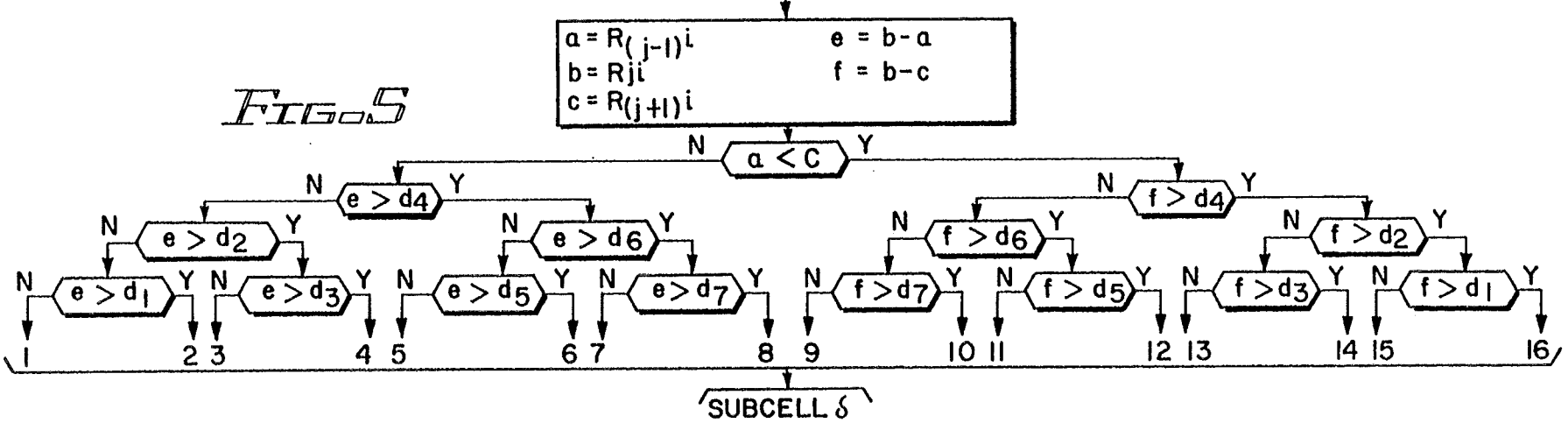
FIG. 5 is a decision tree used in interpolating location of a disturbance using the diagram of FIG. 4.

Perhaps this can be most easily understood by referring to FIG. 4, which illustrates the relative target responses in the leading and trailing range cells (a,c) as target 7 is displaced from the center of range cell b. Sixteen uniformly displaced situations are illustrated representing the boundaries between 16 subcells of range cell b. While one could use the ratio of response "a" to response "c" to interpolate the location of target 7 within range cell b, it is preferable to use the ratio of "a" to "b" for the bottom 8 subcells and the ratio of "c" to "b" for the top 8 subcells. This minimizes the error associated with noise on the response data by using the responses having the largest values. Rather than performing the division associated with these ratios, it is preferable to use the L2 function and use subtraction instead of division. The resulting differences are compared to the following table of values d1,d2, ... d7 in the flow chart shown in FIG. 5. These values of d1,d2, ... d7, which divide range cell 14 into 16 evenly spaced subcells are $d1 = L2(0.9375) = -0.09311$
$d2 = L2(0.8750) = -0.19265$
$d3 = L2(0.8125) = -0.29956$
$d4 = L2(0.7500) = -0.41504$
$d5 = L2(0.6875) = -0.54057$
$d6 = L2(0.6250) = -0.67807$
$d7 = L2(0.5625) = -0.83007$ The output of the subcell decision tree is $\delta$, the number of the subcell having the peak response, where $1 \leqq \delta \leqq 16$. Hence target 7 is located at cell j and subcell $\delta$. This location is referred to as j.$\delta$, and in the present example is 14.11. Note that each subcell is only 0.625 meters (24.6 inches)long and that there are 320 subcells in a 200 meter length of sensor cable. This enables processor 30 to compare the actual target response to the threshold set for that specific location on the perimeter, rather than using a comparison to a single threshold for the entire length of cable, in contrast to all other prior acoustic cable sensor systems.

Rather than declaring an alarm the first time a threshold is exceeded, it is highly desirable to require that there be more than M distinct disturbances within a given period of time (say 3 seconds) within the same subcell or within the two adjacent subcells. This technique of counting the number of times a threshold is exceeded is used in most prior acoustic cable sensors to eliminate false alarms that otherwise would result from balls or other small objects striking the fence on which the acoustic cable is attached. The number of counts M usually is set from 1 to 10.

Figure 6:
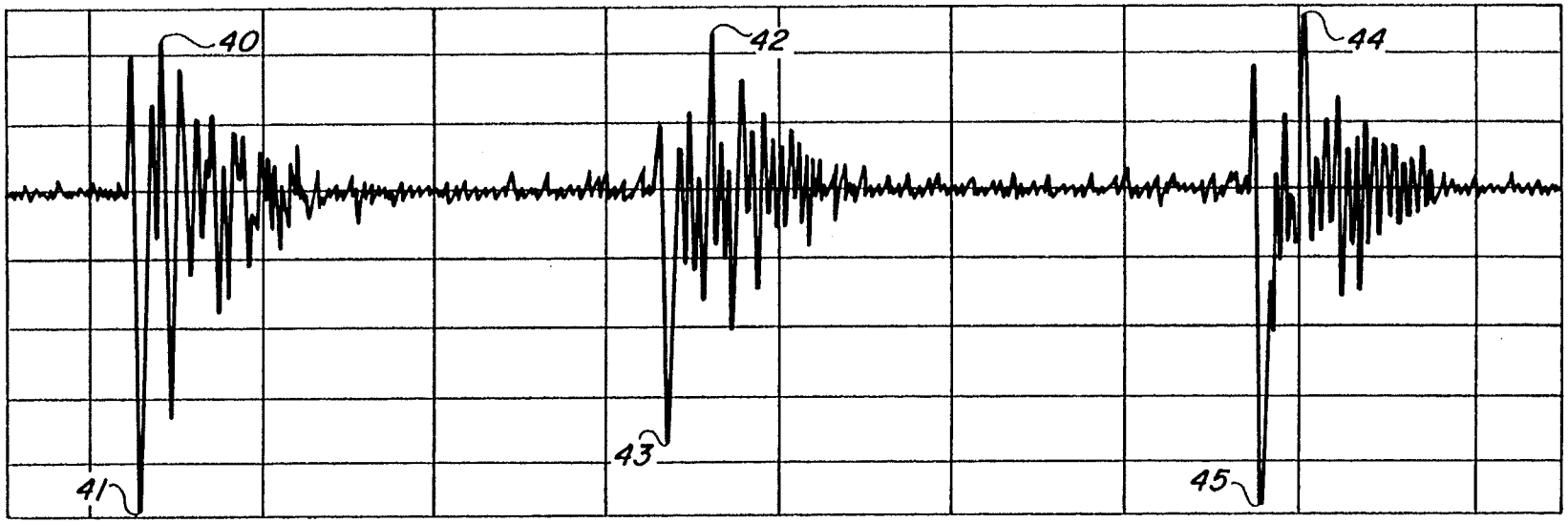
FIG. 6 is a chart illustrating target response of the transducer cable of FIG. 1.

FIG. 6 presents typical responses of the present transducer cable 5 to an intruder climbing on a fence on which cable 5 is installed. In this case, three distinct bursts of response are associated with the intruder's foot striking the fence. The values of $R_{jk}$ would be the L2 of the three peak-to-peak excursions between points 40 and 41, 42 and 43, and 44 and 45, respectively. With M set to 3, an alarm would be declared if all three "strikes" occurred in the same or neighboring subcells and the three peak-to-peak responses exceed the threshold for the subcells identified. This technique is much more likely to both avoid false alarms and reliably detect real intruders than the "strike counting" techniques used in the prior art where the disturbances can occur at random locations on the cable within the given time window.

The threshold values $T_{j.\delta}$, j=1,2, ..., 20 and $\delta$=1,2, ...., 16 are set during the sensor "calibration" procedure. A "calibrate" switch sets processor 30 into a calibration mode. A person walks along the entire 200 meter length of cable, striking the fence "fabric" with a "standard" force at least once every subcell length of 0.625 meters, preferably more often. The above described signal processing proceeds, except that during calibration the responses $R_{jk}$ are stored in the appropriate threshold locations $T_{j.\delta}$, j=1,2, ..., 20 and $\delta$=1,2, ..., 16. After the complete length of cable 5 is calibrated, the "calibrate" switch is turned off.

Note that the foregoing calibration process accounts for variations in the sensitivity of transducer cable 5 due to cable imperfections, condition of fence fabric, location of fence posts, etc. This is in marked contrast to all prior acoustic sensors, which have only one stored threshold value for each transducer cable length. Consequently, the installer must be very concerned about the uniformity of tension in the fence fabric. It is often necessary to place "loops" in prior transducer cables at fence post locations to increase sensitivity in order to account for the "deadening" effect of the fence posts on acoustic cable systems.

A common way of assessing alarms from acoustic cable sensors is for a guard to listen to the audio response thereof. Sample and hold circuit 37 and amplifier 38 in FIG. 1 allow such audio assessment of alarm conditions. Normally, microprocessor 30 would send a signal on conductor 36 to sample and hold circuit 37 to sample and store the analog output of D/A converter 28 at the instant the range cell having the largest target response is being sampled. The output of sample and hold circuit 37 is applied to audio amplifier 38 to produce the desired audio output. Note that because this system "locates" the source of the disturbance 7, the output comes only from the range cell at which disturbance 7 occurs, rather than being an average of all acoustic disturbances as for prior acoustic cable sensors. As described later, this audio output can be sent back over coaxial cable 1,2 to a central location for monitoring. Upon command from a control module, microprocessor 30 can be directed to "listen" to any specific range cell on the cable, whereupon it outputs a signal on conductor 36 at the appropriate time to sample the audio from that selected range cell. This capability is not possible with prior acoustic sensor systems.

While the foregoing description describes the detection and locating of only one "prominent feature" on a 200 meter length of cable, in fact it may be desirable to also select and process the second most "prominent feature". If there should happen to be two intruders climbing on the fence at precisely the same time, both would be detected and located. This is not possible with prior acoustic cable sensor systems. In fact, more features could be selected and processed but two seems to be all that would be required in practical security applications.

The process illustrated in FIG. 1 is essentially that of an MTI (Moving Target Indicating) radar, but confined to "looking" down transducer cable 5 to detect and locate the disturbances caused by an intruder. Although illustrated as a straight line in FIG. 1, cable 5 can go around corners and up and down hills without affecting the detection and location process.

The signal processing according to the present invention reduces the number of false alarms per length of cable for the following reasons:

1. The effects of distributed sources of false alarms such as rain, hail or high wind are minimized because the intruder disturbance is compared to the noise background of a single 10 meter long cell, rather than a 100 or 200 meter long cable.
2. An intruder usually strikes the fence a certain number M times at the same location along the cable while climbing on the fence, while it is extremely unlikely that the alarms that could be cause by "distributed" sources of false alarms, such as rain, hail or high wind could occur M times at the same location.
3. The calibration of transducer cable 5 creates 320 (20 range cells ×16 subcells per range cell) threshold values along its 200 meter length that accurately reflect the sensitivity of the transducer cable 5 in its working environment. In contrast, all other acoustic sensor systems must set only one threshold for the entire length of cable, thereby being incapable of optimal intruder detection for most locations along the cable.

With such reduction in false alarm rate, achievable by the use of multiple individual thresholds, the various thresholds can be lowered to provide a higher probability of detection while preserving an acceptable false alarm rate.

If a further reduction in false alarms due to distributed sources is desired, all thresholds can be increased within certain limits when processor 30 finds a number of large responses at many cable locations within a short period of time, which typically is the case for distributed sources of false alarms. Note that similar "dynamic thresholding" is used in other types of radar.

In high security sites having fences more than 12 feet high, it is usual to attach two parallel acoustic cables to the fence fabric to get adequate detection at both the bottom and top of the fence. In accordance with the present invention, data from parallel cables can be combined to further enhance the sensor performance by demanding the same response from both cables at the same location on the perimeter of the protected area.

Referring to FIG. 7, a cost saving can be realized by time-sharing the processing hardware between two lengths of sensor cable. In FIG. 7 transducer cable A is designated by numeral 5 and transducer cable B is designated by numeral 105. The RF pulse 8 produced by oscillator 20, gate logic 21, low pass filter 22 and amplifier 23 is applied through capacitor 47 to both of transducer cables 5 and 105. The receive signal processing hardware 24, 25, 26, 27, 28, 29, 36,37 and 38 described previously is duplicated as receive signal processing hardware 124, 125, 126, 127, 128, 129, 136, 137 and 138, respectively. Microprocessor 30 has two built-in A/D converter channels with which to process the data from both of transducer cables 5 and 105, respectively. Hence, while A/D converter 33, high pass filter 34 and interpolation and detection algorithm 35 are duplicated by A/D converter 133, high pass filter 134 and interpolation and detection algorithm 135, these are included in the cost of the microprocessor 30 regardless of whether target response signals of one or two transducer cables are to be processed. Microprocessor 30 thus can provide separate alarm outputs for cable A and B, as shown.

The foregoing description all is based upon transducer cable lengths of 200 meter lengths. In practice, there will be many occasions where shorter cable lengths are required. In such cases, the transducer cable is cut to the desired length, but the processor continues to process data as though there were a 200 meter length of cable. During sensor calibration, microprocessor 30 is programmed to set all thresholds beyond the "calibrated length" to an upper limit value, to thereby avoid any responses from the uncalibrated "imaginary range cells".

Figure 8:
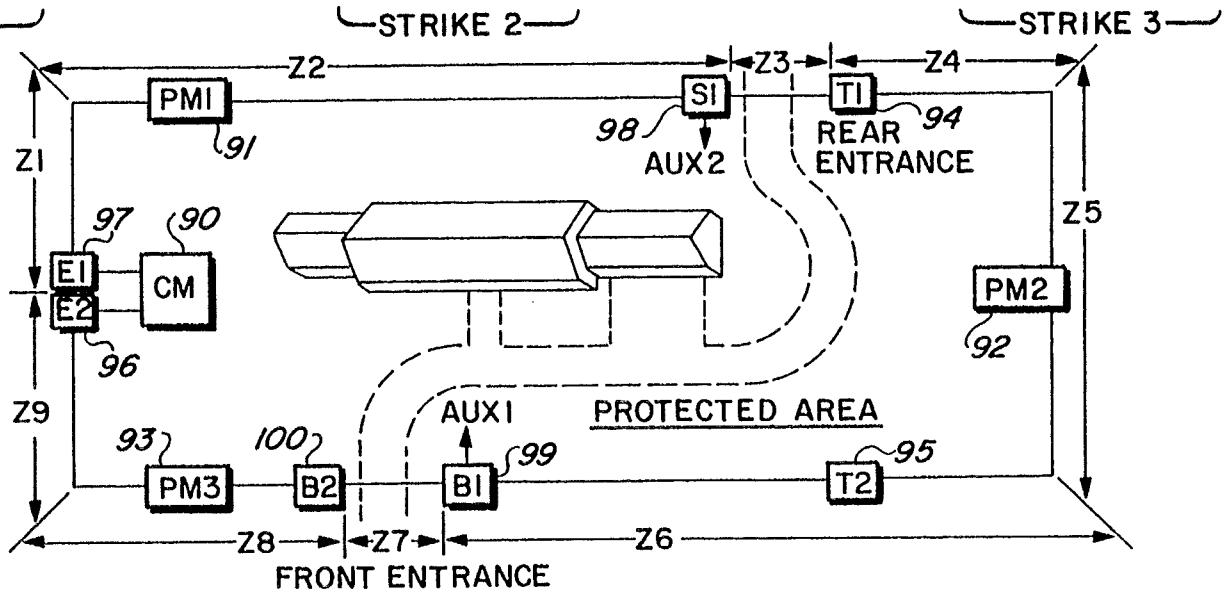
FIG. 8 is a block diagram of a long closed loop perimeter intrusion detection system including multiple series-connected transducer cable systems, wherein power and data are transmitted through all of the transducer cable sections.

In large perimeter protected areas requiring more than the 400 meter capability of a single "processor module" including 200 meters on cable A and 200 meters on cable B, multiple similar processor modules are distributed around the perimeter as illustrated in FIG. 8. Prior art acoustic cable sensor systems would require that power and data lines also be installed around the perimeter to provide power to the processor modules and to conduct the alarm data. For security reasons, such power and data lines are normally required to be installed in electrical conduit and/or buried underground. This is a major expense which is often greater than the cost of the intrusion sensing equipment itself. For the present invention, such costs are essentially eliminated by transmitting power and data over the coaxial portion of the transducer cable 5. In this way, transducer cable 5 protects its own power and data network, which can be made redundant by bringing both ends of the perimeter loop back to a central location.

Figure 9A:
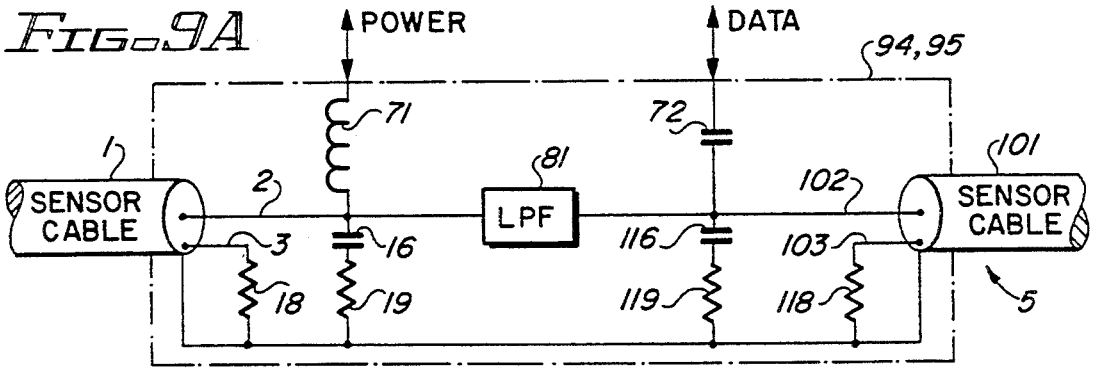
FIGS. 9A–9D are diagrams useful in describing coupling elements of FIG. 8 of the invention.

The coaxial cable formed by conductors 1 and 2 can be connected together by a series of processor modules such as 91, 92 and 93 in FIG. 8 to provide a path for dc power, audio signals, and low frequency data communications around the entire perimeter of the protected area. Capacitors 47 and 48 and inductor 49 as shown in FIG. 7 are used to retrieve the power and data from the path formed by connecting outer conductor 1 to outer conductor 101 and center conductor 2 to outer conductor 102. As shown in FIG. 8, the transducer cables are coupled together by termination units T1 and T2, designated by numerals 94 and 95, respectively. The electrical circuit included in each of termination units 94 and 95 is shown in FIG. 9A. The sense wire lines 3 and 103 are terminated in matching loads 18 and 118. The coaxial center conductors 2 and 102 are terminated at the 5.8 MHz carrier frequency by capacitors 16 and 116 connected in series with resistors 19 and 119, respectively. Low pass filter 81 isolates conductor 2 from conductor 102 at the 5.8 MHz carrier frequency, but connects them together at lower frequencies below 1 MHz. This allows dc power, audio signals from 100 Hz to 3 KHz and data at 300 KHz and 700 KHz to pass unimpeded from one transducer cable to the next.

Figure 9B:
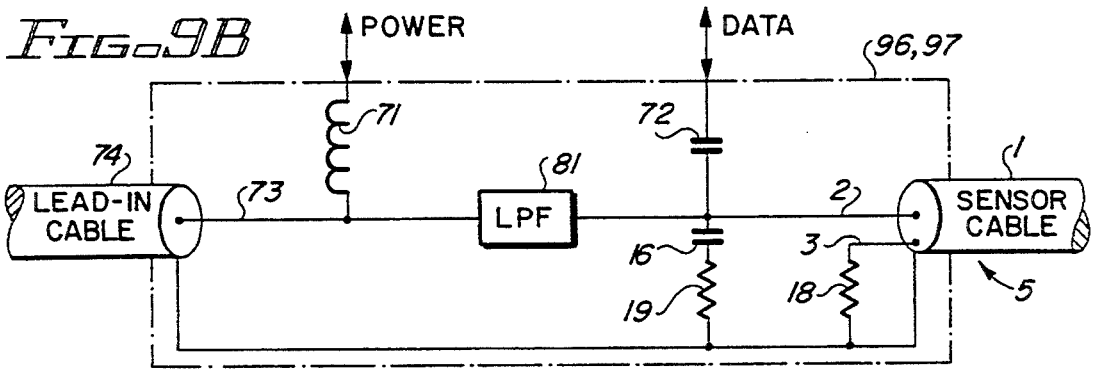

At the end of each path including one or more series-connected transducer cables there is a control module (CM) 90 connected to the ends of the transducer cable paths by ordinary coaxial cable (such as RG58U) by means of end units E1 and E2, designated in FIG. 8 by numerals 96 and 97, respectively. The electrical circuit in such end units is illustrated in FIG. 9B. Resistor 18 provides a matched load to the sense wire transmission line 1,3. Capacitor 16 and resistor 19 provide a matched load to coaxial line 1,2 at the 5.8 MHz carrier frequency. Outer conductor 74 of the lead-in cable is connected to outer conductor 1 of the sensor cable. Center conductor 73 of the lead-in cable is connected to the center conductor 2 of sensor cable 5 by means of low pass filter 81. In this way power, audio and data signals are passed to the lead-in cable and the RF detection signals are terminated at end unit 96 or 97.

Figure 9C:
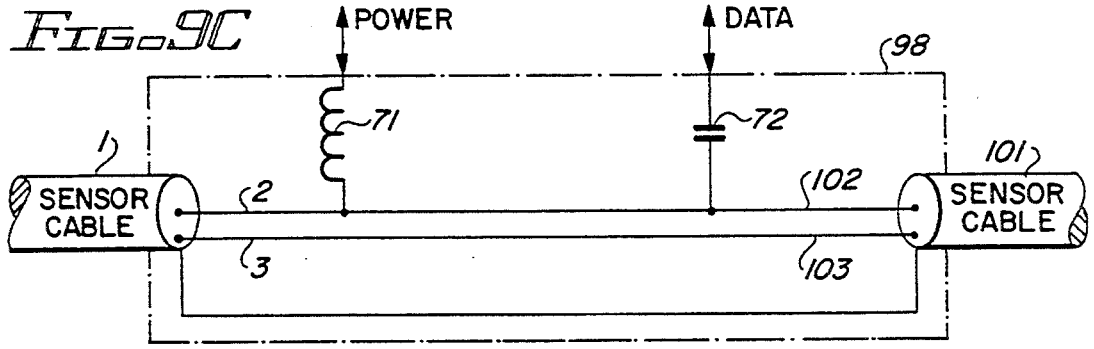

There are occasions when sensor cable 5 is accidentally cut and must be spliced. Such a splice 51 is designated 98 in FIG. 8, and is located between zones Z2 and Z3. The circuit in FIG. 9C shows how the splice unit 98 connects the outer conductors 1 and 101, the coaxial center conductors 2 and 102 and the sense wires 3 and 103 of the two sections of transducer cable 5 together.

Figure 9D:
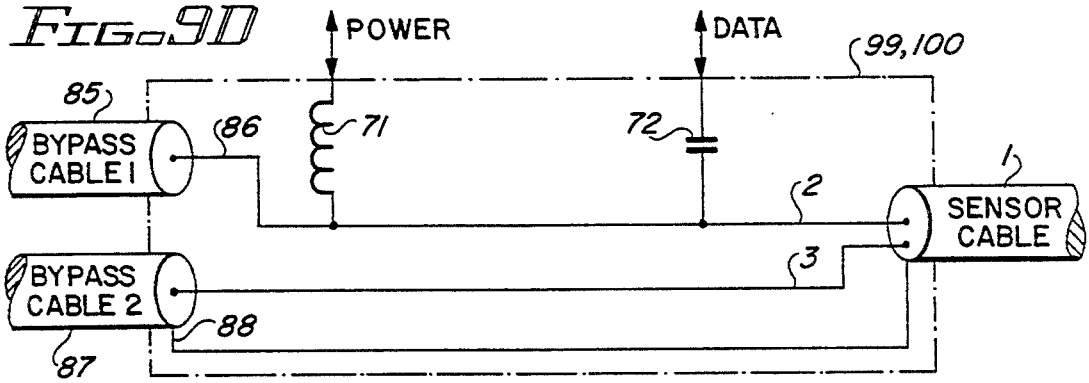

There are occasions when it is desirable to permanently bypass the sensor detection capability, for example across a busy driveway zone Z7 in FIG. 8. Two bypass units B1 and B2, designated by numerals 99 and 100, are shown in FIG. 8. The circuitry in bypass unit B1 and B2 is shown in FIG. 9D.

Control module 90 then provides power over the coaxial cable loop to processor modules PM1, PM2 and PM3 in FIG. 8. A 24 volt dc supply with battery backup is used at the control module 90 so that the sensor cables 5 continue to operate during AC power outages. Voltage regulators are used to derive the 12 volts dc required to power each processor module. The 20 AWG solid copper center conductor 2 used in the construction of sensor cable 5 as illustrated in FIG. 2 is the same as used in standard RG58U coaxial cable, and has a dc resistance of 33.1 ohms per kilometer. The shield resistance for a 95% braid outer conductor is 13.5 ohms per kilometer. Therefore, the total resistance in the dc power network is 46.6 ohms per kilometer. Using this data, the number of processor modules that can be driven over a given length of cable can easily be computed knowing the current requirements of each processor module.

Control module 90 communicates over the loop formed by transducer cable 5 to processor modules PM1, PM2 and PM3. Two redundant frequency shift keying (FSK) communication signals are sent at 300 KHz and at 700 KHz along coaxial cable loop 5. By using two unrelated carrier frequencies, nulls due to standing waves on the data loop are avoided. The data interface at each processor module and control module 90 is handled by a Motorola MC143150 chip and the LONWORKS TM software produced for this IC chip by Echelon Corporation, Inc. of Palo Alto Calif. This data network is used to communicate the following data:

1. alarm signals
2. response levels
3. target location information
4. audio control signals
5. threshold levels
6. cable profile data
7. power supply levels
8. other maintenance data This avoids the need for additional data wiring to each processor module on the perimeter of the posted area.

In many acoustic cable sensor installations, the sensor cables are installed in electrical conduit mounted on a fence. A person climbing on the fence causes the conduit to move, thereby flexing the sensor cable and causing an alarm. In the case of the present invention such conduit not only protects the sensor cables, but also the power and data network.

It is possible to also drive auxiliary devices, such as other sensors or lighting controls or camera controls, over the communication network formed by coaxial transmission line 1,2. To facilitate such applications, the cable coupler units shown in FIGS. 9A–D and each processor module unit shown in FIG. 7 have capacitor 72 coupled to an external port.

It also is possible to augment the power network by injecting dc power through inductor 71 in each of the units shown in FIGS. 9A–D as well as at each processor module shown in FIG. 7. Similarly, limited amounts of power can be extracted from the same ports.

In closed perimeter systems such as the one shown in FIG. 8, power and data can be supplied in either direction, or in both directions around the perimeter to ensure that most of the system continues operating in the event of a cut cable.

In perimeter security systems it is necessary to display alarm response data for use by a guard or response personnel. It is customary to divide the perimeter into a number of detection zones such as the zones Z1, Z2, ..., Z9 shown in FIG. 8. In practice, such zones correspond to particular site features such as corners, roadways, gates etc. In all previous acoustic cable sensors, the starts and ends of detection zones must coincide with the starts and ends of sensor cables. Since each length of cable requires a separate processor, the length of cable per processor is very "site dependent". The cost of the processor is amortized over the cost of the transducer cable to determine a cost per meter for the sensor system. Because the processors are the more expensive part of the system cost, the cost per meter increases substantially as the average zone length decreases. On the other hand, the guard or response force needs to know where to look for an intruder if the sensor system is to meet its intended purpose. This problem is more complex when closed circuit television is used because the zones should match the field of view of particular cameras if the system is to be effective.

In the present invention, all response and target location data are sent to control module 90, which can use this information to define into zones which have no particular relationship to the starts and ends of the sensor cables. Therefore, the sensor system can use the maximum cable length of 400 meters per processor module regardless of the site features thereby substantially reducing the overall system cost in terms of dollars per meter of perimeter while preserving or enhancing the system performance by having as many optimally placed zones as desired.

The control module 90 is programmed to automatically switch the audio from the range cell having the largest target response on the perimeter onto the coaxial cable loop to be monitored at control module 90. In certain cases control module 90 could be programmed to allow the operator to selectively listen to the system response at any selected range cell on the perimeter. The audio response is in the 100 Hz to 3 KHz band on the transducer cable loops.

In some special cases, the customer may wish to display the exact location of the intruder on the perimeter rather than dividing the perimeter up into the usual 50 to 150 meter length zones. In these cases, the control module 90 has the data required to produce such a display, preferably on a CRT using a PC (personal computer) graphics software package.

When transducer cable 5 is used as a buried cable sensor, it detects intruders walking over the surface of the ground. A person walking directly over transducer cable 5 causes a "local" disturbance thereof, whereas a distant source causes a more "widespread" disturbance that affects the entire cable. As explained above, microprocessor 29 is able to distinguish between the two types of disturbances, whereas the inability of prior buried line seismic or acoustic sensors to distinguish between local intruders and disturbances caused by distant sources causes prior sensors has resulted in high incidences of false alarms.

Thus, the above described invention provides a relatively low cost transducer cable intrusion detection system which reduces the false alarm rate while improving the probability of detection of a real intruder. The described transducer cable incorporates a unique internally coupled highly sensitive dual transmission line structure which allows the system to precisely locate the source of a physical disturbance along the length of the transducer cable, using signal processing techniques to divide the length of the transducer cable into numerous range bins or cells and subcells. This facilitates the described cable calibration procedure that sets individual thresholds which vary along the length of the cable for each subcell defined by an interpolation procedure to overcome variations in transducer sensitivity (which may be caused by cable imperfections, fence condition, installation techniques, the rigidity of the fence fabric near posts etc.) along the length of the cable.

The fact that intruders usually affect only one or two range bins, while most sources of false alarms affect the entire cable, enables microprocessor 30 to avoid many false alarms while improving probability of detection of an intruder.

Unlike prior art leaky coaxial sensor cables, transducer cable 5 of the present invention does not rely on external electromagnetic fields to detect the intruder. All of the fields are contained within the single coaxial cable. Transducer cable 5 relies upon the physical coupling of energy from intruders climbing on a fence or cutting through a fence or walking over the soil to cause the disturbance of the sense wire line within the sensor cable to be detected. Because the invention detects disturbances inside the transducer cable, the selection of operating frequency does not need to take into account the radar cross section as when designing a prior art leaky sensor cable. (Most leaky sensor cables operate between 40 and 110 MHz so that a human target is approximately one quarter wavelength long so as to achieve discrimination against small animals.)

Although the above embodiment of the invention has been described mainly as an acoustic fence sensor, it will be clear that the system can be used as a buried seismic intrusion detection sensor or for any number of other applications including sonar sensing. Somewhat different cable constructions can readily be used to achieve the same result. Different signal processing techniques, such as used in Time Domain Reflectometry and CW and/or FM radar also can be readily used. In some high security applications one may install parallel cables and use the correlation of disturbances along the length of the cables to further enhance the sensor performance.

A number of alternate cable constructions in accordance with the present invention are mentioned below.

Eccentric Coaxial Cable with Sense Wire

Figure 10A:
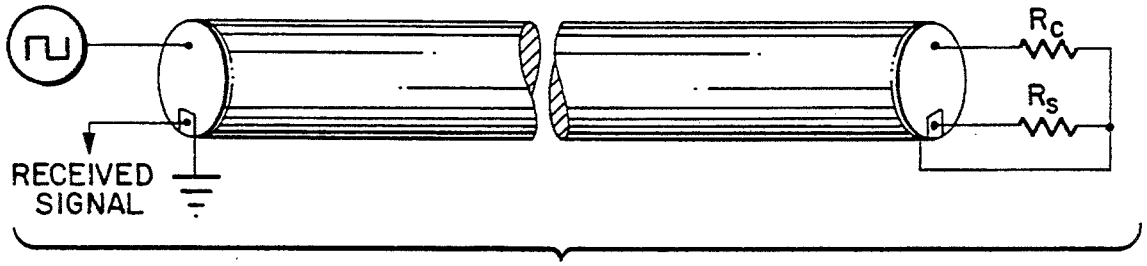
FIGS. 10A–10D are diagrams useful in describing alternate embodiments of the invention.

In another transducer cable construction shown in FIG. 10A, a sense wire can be added to an eccentric coaxial cable. This allows use of a larger diameter sense wire 3 with the same size outer conductor. This has the advantage of reducing attenuation of the sense wire line.

Shielded Twin Lead with Sense Wire

Figure 10B:
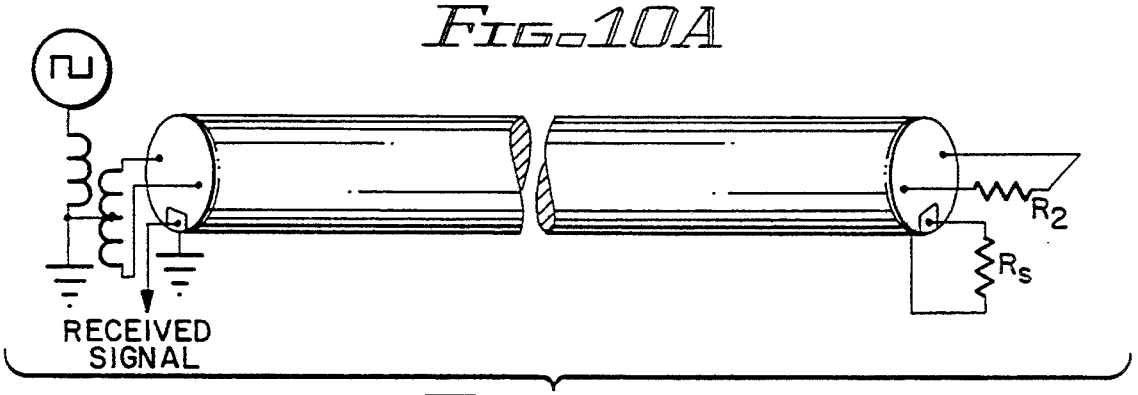

As shown in FIG. 10B, a sense wire can be added to a shielded twin lead transmission line. The transmit pulse 8 is sent down the line in the balanced mode using a tapped transformer. The sense wire slot 4 could be located almost anywhere on the circumference of the shielded twin lead. The receive signal appears between the sense wire and the outer shield, essentially as in the case in the embodiment of FIG. 2.

Floating Twin Lead Cable

Figure 10C:
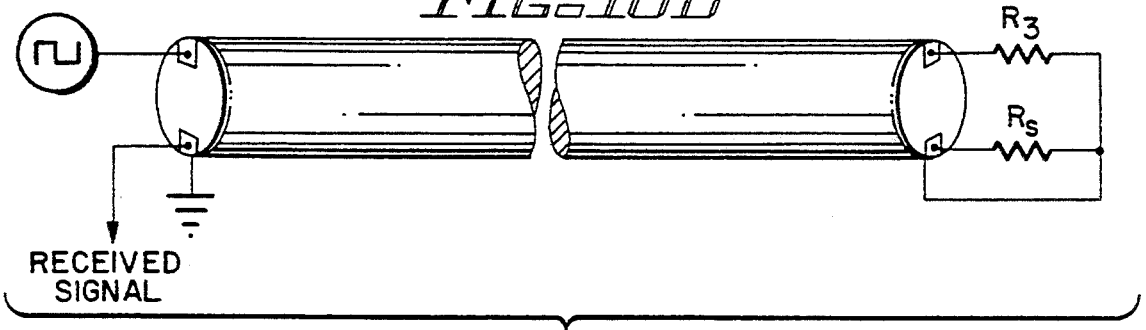

As shown in FIG. 10C, a shielded twin lead in which both conductors are free to move could be used as the transducer cable for the present invention. This cable configuration has the advantage of having the characteristic impedances of both the transmit and receive transmission lines subject to physical motion of the cable. On the other hand it is more expensive to manufacture and the power and data handling capability would be somewhat affected.

Floating Center Conductor Coaxial Cable

Figure 10D:
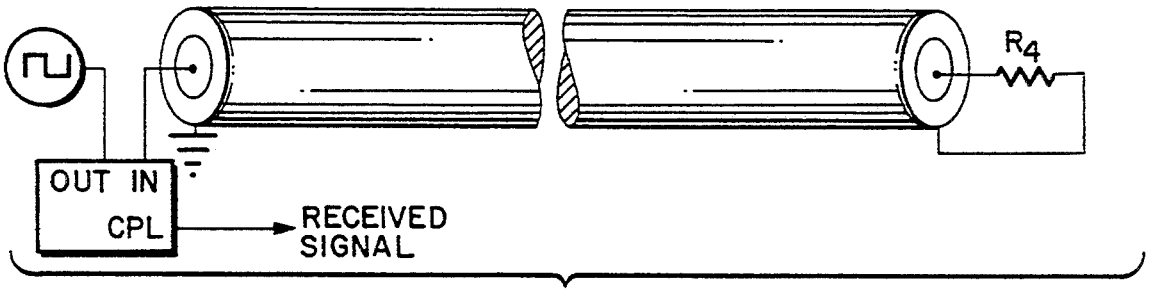

As shown in FIG. 10D, a coaxial cable in which the center conductor is free to move within a cavity can be used as an acoustic cable sensor similar to the present invention. In this case, a directional coupler is used to isolate the received signal from the transmit pulse. The pulse entering the OUT port of the directional coupler appears with little attenuation on the IN port which is connected to the cable. Little of the signal propagating in this direction appears on the CPL (coupled) port. The received signal returning on the cable enters the IN port and exits the CPL port with little attenuation. This received signal is essentially the same as the reflected signal described above.

Waveguide Transmission Line

An electromagnetic waveguide could be used as an acoustic sensor similar to the one described previously herein. As in the case of a floating center conductor coaxial cable, a directional coupler would be used to isolate the received signal from the transmitted signal. As the wall (or walls) of the waveguide move, reflections are created on the line which can be detected and located in accordance with the present invention.

Fiber Optic Cable

Numerous patents have been issued for fiber optic sensors in which an optical detector is at one end of the fiber and an optical source is at the other end. In this configuration physical manipulation of the fiber modulates the transmitted signal. It is this modulation that is detected to determine if an intruder is causing the fiber to move. Light waves have been shown to be electromagnetic in nature and the glass fiber is similar to a waveguide transmission line. It then follows that a reflected wave from physical disturbances from a physical disturbance on the fiber cable would have the same modulation information as the transmitted wave. With the addition of a directional coupler between the source and the fiber otic cable and a detector on the coupled port, a sensor similar to the one described above could be realized in accordance with the present invention.

A number of other signal processing techniques in accordance with the present invention are mentioned below.

Pulse Compression

There are many similarities between the processing of the response data of the present invention and that of classical radar. For example, the "pulse compression" techniques such as those described on pages 420 to 434 in "Introduction to Radar Systems" (Second Edition) by Merrill I. Skolnik, published by McGraw-Hill Book Company, can be used to increase the signal to noise ratio. This enables one to transmit a much longer pulse while preserving the ability to accurately locate the disturbance. It also has the desired effect of keeping the peak power of the transmit pulse small.

Figure 11A:
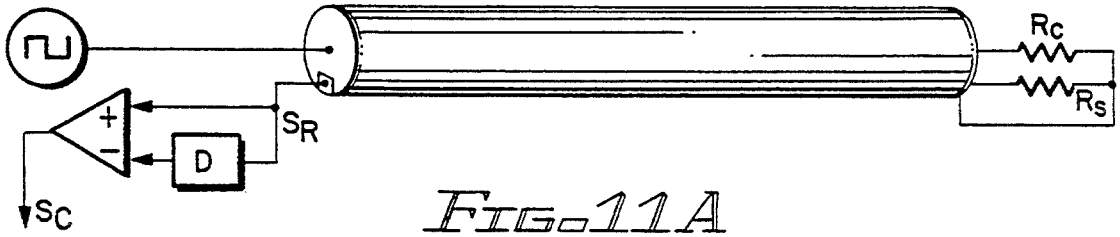

All of the standard radar pulse compression techniques can be applied to the present invention to further enhance the accuracy with which a target can be located and the resolution between multiple targets. One of the simplest pulse compression techniques for the present invention is illustrated in FIG. 11A. The analog received signal shown in FIG. 11B is delayed by one half of the pulse length (80 nanoseconds) and added back to the received signal in a differential mode. The response waveform illustrated in FIG. 11C has a sharp peak response that is only half the pulse width long, which in this case corresponds to a 10 meter length of cable. If this pulse compression technique is to be used, the interpolation algorithm is modified to utilize the narrower pulse.

CW Signal Processing

As in radar, two or more discrete transmit frequencies can be transmitted on the coaxial cable line, and the amplitude and phase of the received signals can be measured. The relative phase angles, instead of the time delay measurement described above, can be used to locate the target. While the location of simultaneous multiple targets becomes complicated using this approach, it is often easier to implement and uses less bandwidth. Although the location is in error for simultaneous multiple targets, in many security applications this may be acceptable.

Direct RF Signal Processing

With only one cycle in the transmit pulse it is possible to dispense with the 26 and to digitize the RF received signal.

Forward Coupled Target Detection

The present invention has been described in terms of backwards coupled transmission lines inside a cable. In other words, the transmitter and receiver are at the same end of the sensor cable. It is possible to place the receiver at the opposite end of the cable from the transmitter. In this way, disturbances of the cable are detected as changes in the forward coupled signal. If the sense wire line and the coaxial transmission line have the same attenuation, this approach has the advantage of eliminating the change in response amplitude due to attenuation. This is because the total signal path length from the transmitter to the disturbance and on to the receiver is the same regardless of the location of the disturbance along the length of the cable. If the coaxial line and the sense wire line have different rates of attenuation, the response will change with the location of the disturbance, and this change can be used to locate the position of the disturbance. However, this change will be much less than that encountered in the backwards coupled sensor case. In addition, if the coaxial line and the sense wire line have the same velocity of propagation, there is no means of locating the disturbance by monitoring the forward coupled signal. If, on the other hand, the two velocities are different, the target location can be determined by using either a pulsed transmission or a multiple frequency CW transmission.

Reciprocal Usage

The present invention has been described with the transmitted signal being applied to the coaxial transmission line and the receiver attached to the sense wire line. Since this detection system is a linear system, it is reciprocal. In other words, it will detect and locate disturbance equally as well with the transmitter connected to the sense wire and the receiver connected to the coaxial cable line.

It should be noted that the I.E.E.E. definition of "microphonic" includes (1) the noise caused by mechanical shock or vibration of elements in a system, and (2) electrical interference caused by mechanical vibration of elements in a signal transmission system.

Figure 12:
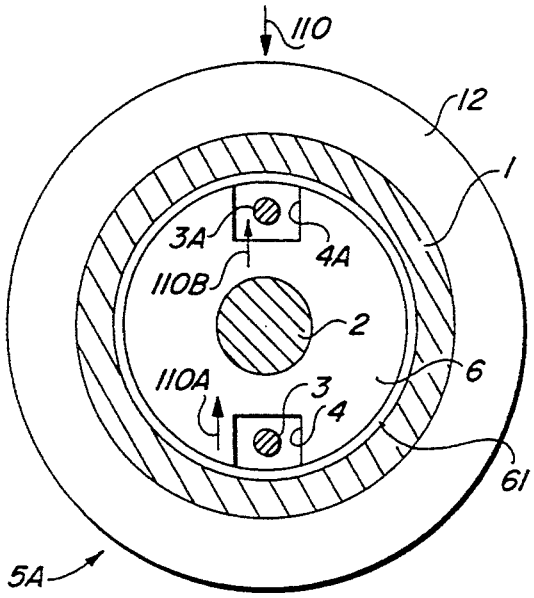
FIG. 12 is a cross sectional view of another embodiment of the transducer cable of the present invention including two floating sense wires and slots therefore.
Figure 13:
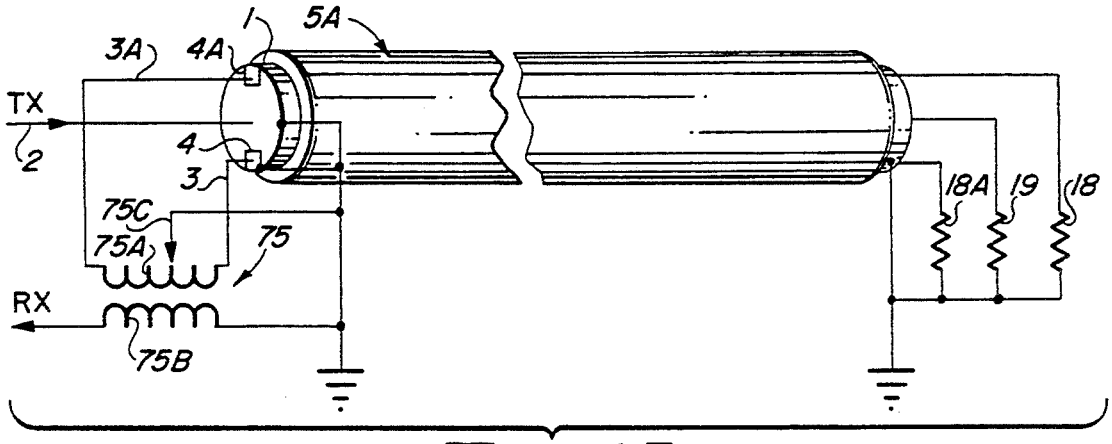
FIG. 13 is a diagram illustrating termination and differential sensing of a signal carried by the two sense wires of the transducer cable illustrated in FIG. 12.

Referring to FIGS. 12 and 13, an alternate transducer cable or reflex cable embodiment 5A is shown. Transducer cable 5A is similar to the embodiment of FIG. 10C, in which two floating sense wires are provided. The structure shown in FIG. 12 also is similar to the structure shown in FIG. 3, except that an additional slot 4A is provided in dielectric sleeve or core 6. Slot 4A is of the same shape as slot 4, but is diametrically opposed thereto. A second "floating" sense wire 3A is provided in slot 4A.

As shown in FIG. 13, transducer cable 5A includes a center conductor 2 terminated in a 50 ohm resistor 19 having resistance in the same fashion as in the embodiment of FIG. 2. Floating sense wires 3 and 3A are terminated in 97 ohm resistors 18 and 18A, respectively.

Instead of connecting the floating sense wires 3 and 3A to inputs of band pass filters as in FIG. 1, however, pulse transformer 75 has one primary winding terminal connected to sense wire 3 and another primary winding terminal connected to sense wire 3A. A center tap 75C is connected by a ground conductor to braided outer shield conductor 1. One terminal of secondary winding 75B of transformer 75 is connected to ground, the other being connected to the RX conductor 76. RX conductor 76 is connected to signal processing circuitry subsequently described with reference to FIG. 1.

If it is desired to provide more "directionality", i.e., increased sensitivity to cable deflections in directions that are generally parallel to arrow 110 of FIG. 12, slots 4 and 4A could be made deeper, and perhaps also narrower.

Figure 14:
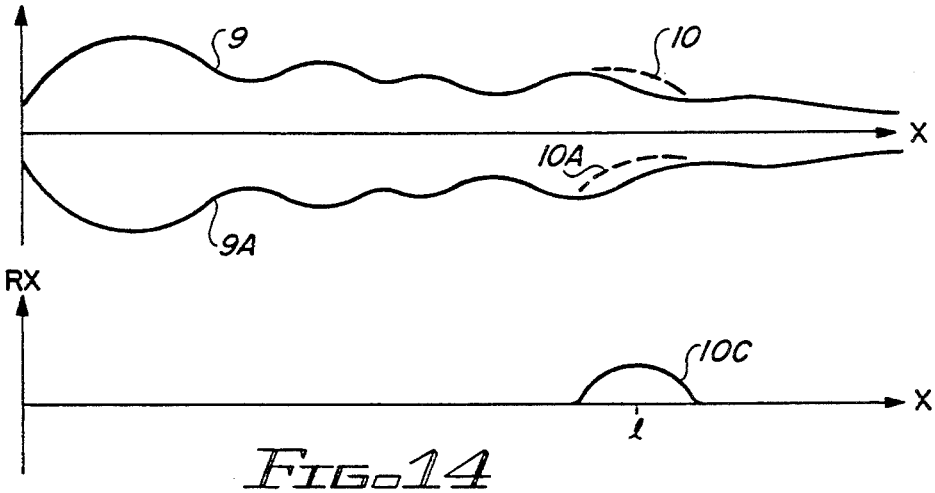
FIG. 14 is a diagram illustrating common mode noise rejection and differential sensing of signals carried by the two floating sense wires in the transducer cable of FIGS. 12 and 13.

Dual floating sense wire transducer cable 5A of FIGS. 12 and 13 provides the substantial advantage (over the embodiment of FIGS. 1 and 2) that common mode noise rejection of the clutter signal or background noise on sense wires 3 and 3A is accomplished, and differential sensing of the reflected target signals on sense wires 3 and 3A also is accomplished. This is illustrated by the timing diagram of FIG. 14 wherein numerals 9 and 9A indicate the clutter or base band responses of sense wires 3 and 3A. Dotted line 10 indicates the amount by which the target response of sense wire 3 differs from its clutter response when transducer cable 5A is deflected at a point λ along its length L. Dotted line 10A indicates the target response of diametrically opposed sense wire 3A. It should be noted that if the deflection of cable 5A is in the direction of arrow 110 in FIG. 12, the relative distance between sense wire 3 and center conductor 2 is decreased, this increases the signal coupling to sense wire 3, causing an increase in the target response 10 relative to the clutter or base band response of sense wire 3. Oppositely, the distance between sense wire 3A and center conductor 2 increases, decreasing the signal coupling therebetween, and therefore decreasing the magnitude of the target response 10A relative to the clutter response of sense wire 3A. The connection of sense wires 3 and 3A to terminals of primary winding 75A connected as shown in FIG. 13 effectively subtracts the total signal response of one of sense wires 3 and 3A from the other, thereby effectively cancelling the clutter responses 9 and 9A, and adding the magnitude of target response decrease 10A to that of the target response increase 10, resulting in target response pulse 10C at the pulse transformer output signal RX.

It should be appreciated that since sense wires 3 and 3A effectively "float" within their corresponding slots 4 and 4A, there is an asymmetric component to their positions relative to center conductor 2, and hence the clutter response signals do not completely cancel. However, on the average, the transformer output signal RX has a zero mean value. Since the two sense wires 3 and 3A tend to bounce against all walls of their respective slots 4 and 4A, the transformer output signal RX will be larger than would occur if only one sense wire were used, but less than the ideal case wherein the transformer output pulse 10C shown in FIG. 14 has double the amplitude of the responses 10 and 10A.

Although the differential sensing accomplished by the primary winding connection of transformer 75 shown in FIG. 13 has the advantage of providing electrical isolation between the RX conductor 76 and the center conductor 2, thereby providing protection from lightning-caused transients, etc. for the signal processing circuitry, it should be appreciated that a differential amplifier could be used instead to accomplish the clutter response cancellation and differential sensing of the combined target responses of sense wires 3 and 3A.

The common mode noise rejection of the differential floating sense wire configuration of FIGS. 12 and 13 results in the substantial advantage of reducing the dynamic range requirement of the signal processing circuitry. The resolution of the digitizing circuitry therein can be reduced from 14 bits to 10 bits. The additional cost of the pulse transformer 75 is much less than the increased cost of digitizing circuitry necessary to accomplish the needed resolution (roughly 16 bits) if the small target response is included with the relatively large clutter response. Furthermore, the previously mentioned problems associated with the increased sensitivity associated with the start and end portions of the transducer cable are avoided by the differential sensing. The reduced dynamic range requirements and differential sensing also make the system much less sensitive to variations in output TX of the transmit circuitry. The two floating sense wires are effectively coupled and parallel, and nicely match the 50 ohm characteristic impedance of the coaxial transmission line.

Figure 15:
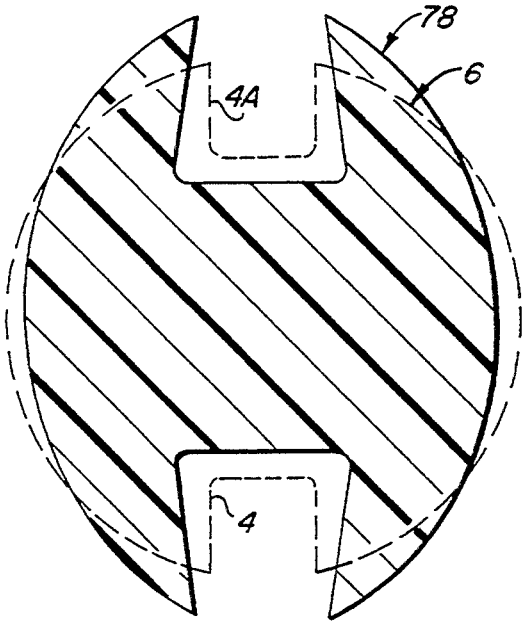
FIG. 15 is a cross sectional diagram illustrating a die used in extruding the dielectric material core of the transducer cable illustrated in FIG. 12.

To manufacture the dual sense wire transducer cable 5A, it was found necessary to utilize a generally elliptical die for extruding the dielectric sleeve 6 in order to have the appearance indicated by dotted line 6 in FIG. 15 after quenching of the molten extruded material.

It was recognized that if lengths of dual sense wire transducer cable 5A are wound tightly on a small diameter reel, the "inner" sense wire would tend to compress and kink, while the "outer" sense wire one would be taut. The kinking exceeds the elastic limit of the inner sense wire, preventing it from completely straightening when the cable 5A is unwound from a small reel. A way of avoiding this problem is to first wind the cable 5A on a large first reel (for example, two feet in diameter) and then remove it from the first reel in a direction parallel to the rotational axis thereof so that every rotation of the second reel produces a 360° twist in each circumferential length of the cable 5A. The thus twisted cable 5A then can be rewound onto a smaller reel. Then, neither sense wire 3 or 3A will be the "inner" sense conductor, so kinking of the inner conductor should be largely avoided.

Once one has obtained the "audio" response from a particular cell it can be processed to enhance the signal to increase the probability of detection and to reject false alarms. Most of the techniques developed for speech recognition can be applied. For example, a "short time average zero-crossing rate" such as described in Digital Processing of Speech Signals by L.R. Rabiner and R.W. Schafer, published by Prentice-Hall Inc., can be used to estimate the dominant frequency content of the response burst. In this case it is the natural frequency of the wires vibrating in the keyways. Since this frequency information is correlated both in time and along the cable for a specific disturbance, it can be used to enhance performance. In fact, nearly all of the speech recognition techniques in use today can be applied to recognized alarm responses and to eliminate known sources of false alarms such as rain or wind on a fence mounted sensor.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. One embodiment of the present invention uses the phase angle of a Continuous Wave (CW) transmission to detect and locate the disturbance of the cable. Like a CW radar (such as a radar altimeter), this greatly simplifies the electronic circuitry but it essentially limits the ability of the sensor to accurately locate the target when more than one target is present at one time. An application as an outdoor perimeter security sensor it would be rare to have multiple simultaneous intruders but when it does happen it could be important to recognizes that there are multiple intrusions. In another embodiment of the invention, an impulse or step function can be transmitted much like a Time Domain Reflectometer (TDR). This approach is also relatively simple to implement and it does detect and locate multiple targets. It does however require the use of the entire bandwidth of the cable thereby preventing multiple simultaneous usage of the cable to provide other functions such as data communication and power transmission.

What is claimed is:

1. A transducer cable comprising in combination:

(a) a first conductor;

(b) a second conductor generally parallel to the first conductor;

(c) solid non-magnetic dielectric material on opposed sides of the first conductor and between the first conductor and the second conductor, (d) first and second longitudinal passages extending through the dielectric material, corresponding portions of the first and second longitudinal passages being located on opposed sides of the first conductor, respectively; and (e) first and second sense wires extending through loosely fitting in the first and second passages, respectively, cross sections of the first and second sense wires being substantially smaller than that of their respective passages so that physical movement of the transducer cable results in free movement in generally opposed directions of the first and second sense wires relative to the the first conductor, resulting in corresponding changes in the characteristic impedance of a first transmission line formed by the first sense wire and the the first conductor and corresponding changes in the characteristic impedance of a second transmission line formed by the second sense wire and the the first conductor.

2. The transducer cable of claim 1 wherein the first and second conductors and the first and second sense wires are parallel.

3. The transducer cable of claim 2 wherein the first conductor is an inner conductor, the second conductor is an outer conductor, the outer conductor being generally tubular, the dielectric material being inside the outer conductor.

4. The transducer cable of claim 3 wherein the dielectric material is generally cylindrical, and the first and second passages are slots in an outer portion of the dielectric material.

5. The transducer cable of claim 4 further including a layer of dielectric material covering the first and second slots.

6. The transducer cable of claim 5 including a first termination matched to a characteristic impedance of the first transmission line and connected between the first sense wire and the outer conductor, and a second termination matched to the characteristic impedance of the second transmission line and connected between the second sense wire and the outer conductor, and a third termination matched to a characteristic impedance of a third transmission line formed by the inner conductor and the outer conductor and connected between the inner conductor and the outer conductor.

7. An intrusion detection system, comprising in combination:

(a) a transducer cable including i. a first conductor, ii. a second conductor, iii. dielectric material on opposed sides of the second conductor and between the first conductor and the second conductor, iv. first and second longitudinal passages extending through the dielectric material, corresponding portions of the first and second longitudinal passages being located on opposed sides of the second conductor, and v. first and second sense wires extending through and loosely fitting in the first and second passages, respectively, so that physical movement of the transducer cable results in free movement of the first and second sense wires in generally opposite directions relative to the second conductor, causing corresponding changes in the characteristic impedance of a first transmission line formed by the second conductor and the first sense wire and in the characteristic impedance of a second transmission line formed by the second conductor and the second sense wire;

(b) a transmitting circuit adapted to transmit an RF signal down a third transmission line formed by the first conductor and the second conductor, an electromagnetic field being produced along the first conductor by the RF signal and coupling energy to the first and second transmission lines, an intrusion activity causing movement of the transducer cable resulting in movement of the first and second sense wires in the first and second passages, respectively, in generally opposite directions relative to the second conductor and changing characteristic impedances of the first and second transmission lines at portion thereof including the relative movement, the characteristic impedance changes causing reflection of a portion of the coupled energy back along the first and second transmission lines toward the transmitting circuit, the first and second sense wires carrying a differential first signal representative of the reflected energy; and (c) a receiver circuit connected to receive the differential first signal and operative to produce a second signal representative of the occurrence of the activity.

* * * * *